US009138610B2

(12) United States Patent
Lovegrove et al.

(10) Patent No.: US 9,138,610 B2
(45) Date of Patent: Sep. 22, 2015

(54) EXERCISE EQUIPMENT

(75) Inventors: David Neil Lovegrove, Christchurch (NZ); Darryl John Best, Christchurch (NZ); William Davies, Devon (GB); Tyrone David Low, Wanganui (NZ)

(73) Assignee: Les Mills International Limited, Auckland (NZ)

( * ) Notice: Subject to any disclaimer, the term of this patent is extended or adjusted under 35 U.S.C. 154(b) by 176 days.

(21) Appl. No.: 13/818,077

(22) PCT Filed: Aug. 26, 2011

(86) PCT No.: PCT/NZ2011/000171

§ 371 (c)(1),
(2), (4) Date: Mar. 26, 2013

(87) PCT Pub. No.: WO2012/026834

PCT Pub. Date: Mar. 1, 2012

(65) Prior Publication Data

US 2013/0184129 A1 Jul. 18, 2013

(30) Foreign Application Priority Data

Aug. 27, 2010 (NZ) ..... 587626

(51) Int. Cl.

| | |
|---|---|
| ***A63B 21/072*** | (2006.01) |
| ***A63B 21/075*** | (2006.01) |
| ***A63B 21/06*** | (2006.01) |
| ***A63B 23/12*** | (2006.01) |

(52) U.S. Cl.

CPC ..... *A63B 21/0728* (2013.01); *A63B 21/0724* (2013.01); *A63B 21/0726* (2013.01); *A63B 23/1281* (2013.01); *A63B 2021/0722* (2013.01)

(58) Field of Classification Search

CPC ..... A63B 21/00; A63B 21/06; A63B 21/072; A63B 21/0724; A63B 21/0728; A63B 21/075

USPC ..... 482/92, 93, 106–108

See application file for complete search history.

(56) References Cited

U.S. PATENT DOCUMENTS

| | | | | |
|---|---|---|---|---|
| 4,029,312 | A * | 6/1977 | Wright | 482/108 |
| D274,283 | S | 6/1984 | Wright | |
| 4,579,337 | A * | 4/1986 | Uyeda | 482/107 |

(Continued)

FOREIGN PATENT DOCUMENTS

| | | | |
|---|---|---|---|
| CN | 1658928 | A | 8/2005 |
| CN | 28287448 | Y | 10/2006 |

OTHER PUBLICATIONS

International Search Report and Written Opinion of PCT/NZ2011/000171, mailed on Feb. 12, 2011, 5 pages.

(Continued)

*Primary Examiner* — Stephen Crow
*Assistant Examiner* — Garrett Atkinson
(74) *Attorney, Agent, or Firm* — Kilpatrick Townsend & Stockton LLP

(57) ABSTRACT

Exercise equipment comprising a grippable handle at which said exercise equipment can be lifted by a user, and at least one docking assembly connected to the grippable handle. The docking assembly has opposing arms that define a slot in which at least one weight plate can be removably mounted. At least one locking member is located on the docking assembly to capture and/or lock at one weight plate to the docking assembly once received in the slot.

34 Claims, 27 Drawing Sheets

(56) References Cited

U.S. PATENT DOCUMENTS

| | | | | |
|---|---|---|---|---|
| 4,618,142 | A * | 10/1986 | Joseph, Jr. | 482/82 |
| 4,632,391 | A | 12/1986 | Orak | |
| D302,195 | S | 7/1989 | Orak | |
| 4,854,575 | A | 8/1989 | Wilson et al. | |
| 5,421,797 | A * | 6/1995 | Fletcher | 482/106 |
| 5,692,944 | A | 12/1997 | Pellicone | |
| D438,265 | S | 2/2001 | Fenelon | |
| 6,416,446 | B1 | 7/2002 | Krull | |
| 6,461,282 | B1 | 10/2002 | Fenelon | |
| 6,702,723 | B2 * | 3/2004 | Landfair | 482/93 |
| 6,736,765 | B2 * | 5/2004 | Wallace et al. | 482/106 |
| 6,746,380 | B2 | 6/2004 | Lien et al. | |
| 6,971,974 | B2 * | 12/2005 | Bowman et al. | 482/107 |
| 7,014,598 | B2 | 3/2006 | Fenelon et al. | |
| 7,128,696 | B1 | 10/2006 | Krull | |
| 7,491,155 | B2 | 2/2009 | Fenelon et al. | |
| 7,704,197 | B2 * | 4/2010 | Yu | 482/108 |
| 7,878,952 | B2 | 2/2011 | Fenelon | |
| 8,025,613 | B1 * | 9/2011 | Wang | 482/107 |
| 8,047,971 | B2 * | 11/2011 | Parker | 482/104 |
| 8,287,438 | B2 * | 10/2012 | Krull | 482/98 |
| 8,506,460 | B2 * | 8/2013 | Seitzer | 482/106 |
| 2005/0096200 | A1 | 5/2005 | Amann | |
| 2006/0073948 | A1 | 4/2006 | Lincir | |
| 2007/0161474 | A1 | 7/2007 | Lippitt | |
| 2009/0048079 | A1 | 2/2009 | Nalley | |
| 2009/0156376 | A1 | 6/2009 | Fenelon et al. | |
| 2010/0190618 | A1 | 7/2010 | Chen | |
| 2012/0021877 | A1 * | 1/2012 | Lundquist et al. | 482/107 |

OTHER PUBLICATIONS

Translation of European Search Report and Written Opinion of PCT/NZ2011/000171, mailed on Jan. 23, 2014, 2011, 18 pages.

* cited by examiner

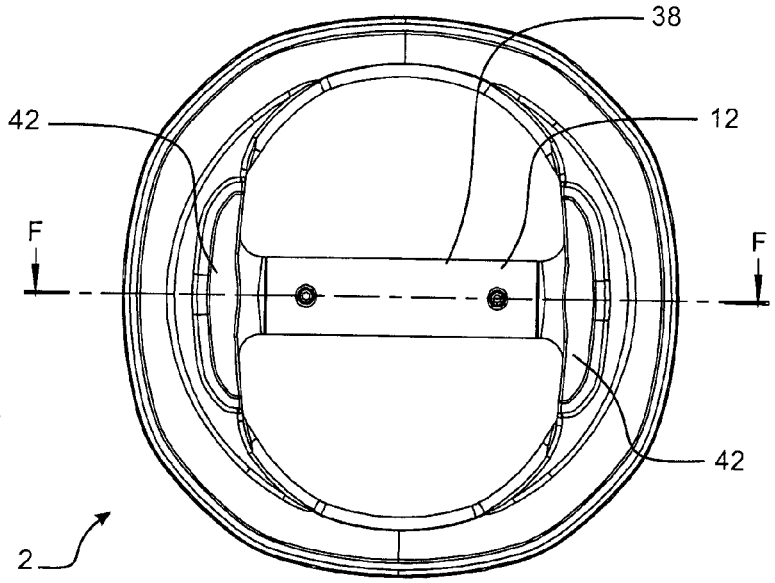
FIGURE 27
FIGURE 28
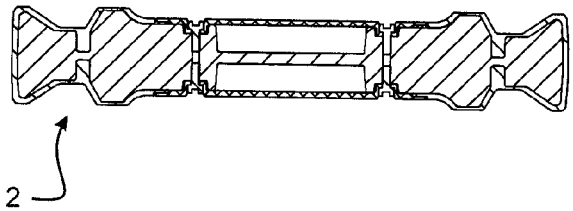
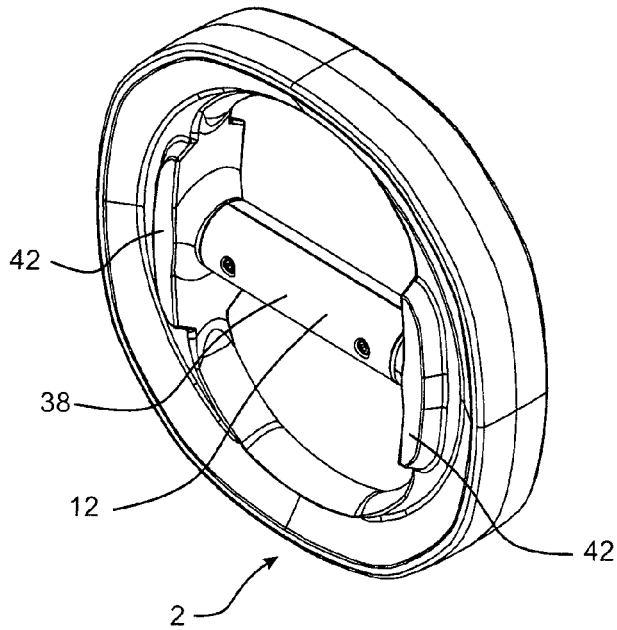
FIGURE 29

EXERCISE EQUIPMENT

FIELD OF THE INVENTION

The present invention relates to exercise equipment and in particular to a weight training device or system and related coupling.

BACKGROUND

Weight training devices are commonly used in the fitness industry. Devices such as barbells may be used in a number of different ways in order for an individual to exercise particular muscles or muscle groups.

A common barbell system consists of a metal bar, one or more sets of disc shaped weight plates and a set of collars. The weight plates can be slid onto either end of the metal bar. Collars can then be used to lock the weight plates to the bar so that they cannot move during use. Such a system is reliable but it can be time consuming having to remove a collar from the bar for each set of plates in order to change the weight plates that are located on the bar. Such existing systems hence do not readily lend themselves to situations where people are exercising as part of a class and are following a programme that requires rapid and/or frequent changing in the weight that they are handling.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purposes of this specification, the term "exercise equipment" shall be construed to mean a general term for a wide range of devices suitable for exercise, fitness, rehabilitation or any other similar activity.

For the purposes of this specification, the term "docking assembly" shall be construed to mean a general term for a wide range of objects that may act as a hub to dock or receive other objects.

For the purposes of this specification, the term "slot" shall be construed to mean a general term for the space between two arms of any configuration or shape.

SUMMARY OF THE INVENTION

It is an object of the present invention to provide exercise equipment and/or weight training system which overcomes or at least partially ameliorates some of the abovementioned disadvantages or which at least provides the public with a useful choice.

It is a further or alternative object of the present invention to provide an exercising apparatus useable as if a barbell set where its weight plates can be added for automatic retention on each end of the bar.

In a first aspect the present invention consists in exercise equipment comprising:

a grippable handle at which said exercise equipment can be lifted by a user, a docking assembly connected to the grippable handle, the docking assembly defining a slot at which at least one weight plate can be removably mounted and having at least one locking member to lock the at least one weight plate to the docking assembly once received at the slot.

Preferably said exercise equipment further comprises an elongate bar that defines the grippable handle.

Preferably a said docking assembly is engaged with the bar at each end of the bar.

Preferably a said docking assembly is engaged with the bar at each end of the bar in a manner to allow the at least one weight plate to rotate relative to said bar.

Preferably a said docking assembly is engaged with the bar at each end of the bar in manner to allow the docking assembly to rotate relative to the bar.

Preferably the exercise equipment also comprises at least one weight plate.

Preferably said at least one weight plate includes a mounting region by which said weight plate is capable of being mounted to the docking assembly.

Preferably the mounting region of said at least one weight plate is received in the slot of the docking assembly.

Preferably the slot is dimensioned to receive said weight plate at its mounting region in a sliding manner.

Preferably the slot is an elongate slot that extends in a direction parallel to the elongate bar.

Preferably the mounting region of the weight plate is defined by a handle that extends in a direction that substantially bisects the weight plate.

Preferably the docking assembly defines bearing surfaces at the slot that are at least in part complementary in shape to at least part of the mounting region of the weight plate to allow a snug receipt of the weight plate at the slot of the docking assembly.

Preferably the slot is defined by arms (herein after "opposed arms") at opposed sides of the slot of the docking assembly.

Preferably the at least one locking member extends partially into the slot from at least one of the opposed arms.

Preferably the at least one locking member extends partially into the slot from both of the opposed arms.

Preferably both opposed arms of the docking assembly carry a plurality of locking members.

Preferably both arms of the docking assembly each carry three locking members to define three opposed pairs of locking members, each pair cooperating, in use, to lock a mounting region of a weight plate to the docking assembly.

Preferably said at least one locking member is able to move relative to said opposed arms and between a first locking position and a second unlocked position.

Preferably at least one locking member extends into the slot more so when in the first locking position than in the second unlocked position.

Preferably at least one locking member can move between the first locking position wherein said at least one locking member extends at least partially into the slot and the second unlocked position wherein the at least one locking member is at least partially retracted into a respective arm of said opposed arms.

Preferably said at least one locking member is pivotally mounted to rotate about a pivot axis relative to said slot such that each locking member can pivot between the first locking position and the second unlocked position.

Preferably said at least one locking member is pivotally mounted to rotate about a pivot axis relative to said slot such that each locking member can pivot between a first weight plate locking position holding said weight plate to said docking member and the second weight plate unlocked position allowing said weight plate to be removed from the docking member.

Preferably the locking members are biased to the first locking position.

Preferably a torsion spring is associated with each locking member and biases each locking member to the first locking position.

Preferably as a weight plate is received by the slot it pushes against the bias of each locking member or pair of locking members so that each locking member pivots to the unlocked position momentarily until the weight plate is slid deeper into the slot and past the locking member, where the locking member returns under bias to its locking position.

Preferably a plurality of weight plates can be sequentially received at the slot of the docking assembly, each weight plate being locked in place by a pair of locking members.

Preferably the at least one locking member is moveable or freed to be able to be moved by manipulation of an actuator.

Preferably the actuator has a translating cam profile corresponding with the or each locking member, the translating cam profile bearing against a follower of the locking member such that linear movement of the actuator causes the locking member to pivot about its pivot axis as the follower is moved by the translating cam profile.

Preferably the actuator is moved by a release catch, the catch able to be pulled away from the docking assembly to thereby retract or allow retraction of the locking members.

Preferably the release catch is biased for movement toward the docking assembly.

Preferably the docking assembly can receive a plurality of weight plates.

Preferably the plurality of weight plates each have identical mounting regions.

Preferably the plurality of weight plates are able to be held by the docking assembly in a contiguous manner.

Preferably when held by the docking assembly the plane of the plurality of weight plates is substantially perpendicular to the longitudinal axis of the grippable handle.

Preferably the plurality of weight plates can be kept in alignment when held by the docking assembly as they are positioned against one another.

Preferably each weight plate has at least one support face on each of its sides, each support face positioned to butt against the support face of like, adjacent weight plates to maintain the pitch of the weight plates when a plurality of weight plates are positioned adjacent one another at the docking assembly.

Preferably each weight plate has at least one outer gripping region.

Preferably said at least one outer gripping region comprises two diametrically opposed openings in each weight plate that define handles with and at the perimeter of the weight plate for gripping by a user in use.

In a further aspect the present invention consists in weight training system comprising:

a plurality of weight plates, an elongate bar, a docking assembly at each end of the elongate bar, each docking assembly able to receive and hold at least one of said plurality of weight plates, wherein each docking assembly defines a slot at which at least one of said plurality of weight plates can be removably mounted, and wherein each docking assembly has at least one locking member to lock the at least one weight plate to the docking assembly when received in the slot.

Preferably said elongate bar defines a grippable handle.

Preferably a docking assembly is engaged with the bar at each end of the bar in a manner to allow the at least one weight plate to rotate relative to said bar.

Alternatively a docking assembly is engaged with the bar at each end of the bar in manner to allow the docking assembly to rotate relative to the bar.

Preferably each weight plate includes a mounting region at which it is mounted to said docking assembly.

Preferably the mounting region of each weight plate can be removably received at the slot of the docking assembly.

Preferably the slot is dimensioned to receive at least one weight plate at its mounting region in a sliding manner.

Preferably the sliding manner is in a direction parallel to the axis of the elongate bar.

Preferably the mounting region of the weight plate is defined by a handle that extends in a direction that substantially bisects the weight plate.

Preferably the docking assembly defines bearing surfaces at said slot that are at least in part complementary in shape to at least part of the mounting region of the weight plate to allow a snug receipt of the weight plate at the slot.

Preferably the at least one locking member extends partially into the slot from at least one of two opposed arms between which said slot extends, of said docking assembly.

Preferably at least one said locking member extends partially into the slot from two opposed arms between which said slot extends, of said docking assembly.

Preferably both opposed arms of the docking assembly carry a plurality of locking members.

Preferably both opposed arms of the docking assembly each carry three locking members to define three opposed pairs of locking members, each pair cooperating, in use, to lock the mounting region of a weight plate to the docking assembly.

Preferably the locking members are able to move between a first locking position and a second unlocked position.

Preferably each locking member extends partially into the slot when in the first locking position and are retracted into the docking assembly in the second unlocked position.

Preferably each locking member is pivotable about a pivot axis and is pivotally mounted to the housing of the docking assembly such that it can pivot between the first locking position and the second unlocked position.

Preferably each locking member is biased to the first locking position.

Preferably a torsion spring is associated with each locking member and biases it to the first locking position.

Preferably as a weight plate is received by the slot it may push against the bias of the locking member so that the locking member pivots toward the unlocked position momentarily until the weight plate is slid deeper into the slot and past the locking member.

Preferably a plurality of weight plates may be sequentially received by the docking assembly at the slot, each weight plate being locked in place by a pair of locking members carried by opposed arms of the docking member between which the slot is located.

Preferably the locking members are moveable by manipulation of an actuator.

Preferably the actuator has a translating cam profile corresponding with each locking member; the translating cam profile bears against a follower of the locking member such that linear movement of the actuator causes the locking member to pivot about its pivot axis as the follower is moved by the translating cam profile.

Preferably the actuator can by moved by a release catch, the catch being pulled away from the docking assembly to retract the locking members.

Preferably the release catch is biased toward the docking assembly.

Preferably the plurality of weight plates have identical mounting regions.

Preferably the plurality of weight plates are held by the docking assembly in a manner contiguous or stacked adjacent each other.

Preferably when held on the docking assembly the plane of each weight plate is substantially perpendicular to the longitudinal axis of the bar.

Preferably each weight plate has at least one support face on each of its sides, each support face positioned to butt against the support face of like, adjacent weight plates to maintain a pitch of the weight plates when a plurality of weight plates are positioned adjacent one another at the docking assembly.

Preferably each weight plate has at least one outer gripping region.

Preferably said at least one outer gripping region is defined by two openings one on each side of the mounting region and the perimeter of the plate to form handles for gripping by a user in use at the perimeter of the plate.

In a further aspect the present invention consists in a docking assembly for mounting at least one weight plate thereto, the docking assembly comprising or including:

a pair of opposed arms which define a slot at which said at least one weight plate can be removably mounted, wherein the docking assembly has at least one locking member to lock said at least one weight plate to the docking assembly when received in the slot.

Preferably the weight plate includes a mounting region at which it can be mounted to the docking assembly.

Preferably the mounting region of each weight plate is received at the slot of the docking assembly.

Preferably the slot is dimensioned to receive at least one weight plate at its mounting region in a sliding manner.

Preferably the mounting region of the weight plate is defined by a handle that extends in a direction that substantially bisects the weight plate.

Preferably the slot has bearing surfaces that are at least in part complementary in shape to at least part of the mounting region of the weight plate to allow a snug receipt of the weight plate into the slot of the docking assembly.

Preferably the docking assembly has at least one locking member that extends partially into the slot from either arm of the docking assembly.

Preferably the docking assembly has at least one locking member that extends partially into the slot from both arms of the docking assembly.

Preferably both opposed arms of the docking assembly carry a plurality of locking members.

Preferably both opposed arms of the docking assembly each carry three locking members to define three opposed pairs of locking members, each pair cooperating, in use, to lock the mounting region of a weight plate to the docking assembly.

Preferably the locking members are able to move between a first locking position and a second unlocked position relative said arms.

Preferably each locking member extends partially into the slot when in the first locking position and are retracted into the arms of the docking assembly in the second unlocked position.

Preferably each locking member is pivotable about a pivot axis and is pivotally mounted to the housing of the docking assembly such that it can pivot between the first locking position and the second unlocked position.

Preferably the locking members are biased to the first locking position.

Preferably a torsion spring associated with each locking member biases it to the first locking position.

Preferably as a weight plate is received by at slot it may push against the bias of the locking member so that the locking member pivots to the unlocked position momentarily until the weight plate is slid deeper into the slot and past the locking member.

Preferably a plurality of weight plates may be sequentially received at the slot, each weight plate being locked in place by a pair of locking members carried by the opposed arms.

Preferably the locking members are moveable by manipulation of an actuator.

Preferably the actuator has a translating cam profile corresponding with each locking member; the translating cam profile bears against a follower of the locking member such that linear movement of the actuator causes the locking member to pivot about its pivot axis as the follower is moved by the translating cam profile.

Preferably the actuator can by moved by a release catch, the catch being pulled away from the docking assembly to retract the locking members.

Preferably the release catch is biased toward the docking assembly.

Preferably the docking assembly can receive a plurality of weight plates.

Preferably the plurality of weight plates have identical mounting regions.

Preferably the plurality of weight plates are held on the docking assembly in a contiguous or abutting manner.

Preferably each weight plate has at least one support face on each of its sides, the support face positioned to but against the support face of like, adjacent weight plates to maintain a pitch of the weight plates when a plurality of weight plates are positioned adjacent one another on said docking assembly.

Preferably each weight plate has at least one outer gripping region.

Preferably said at least one outer gripping region defined by at least one aperture through said weight plate at and with said perimeter of the weight plate.

In a further aspect the present invention consists in a weight training device assembly, or kit set there for, where at each end region of its bar, or bar assembly ("bar"), there are outwardly extending formations between which mounting regions of each weight plate can be brought to be retained or docked by a locking member or locking members deployed by a bias and shaped and adapted to prevent removal of the weight plate outwardly of the bar and formations, such locking member(s) able to be moved to a less deployed condition to allow removal of the weight plate from the bar and formations.

In a further aspect the present invention consists in An exercising apparatus having two weight plate docking assemblies, one at each end of the "bar" (or its equivalent), and each to provide a docking region for part of each of a plurality of complementary weight plates, each weight plate, able to be locked (preferably individually) to the docking assembly.

In a further aspect the present invention consists in an assembly or a kit set for an exercising apparatus in the form of:

a bar, and a bifurcated assembly supported at each end of the bar, each such assembly being adapted to engage one or more complementary weight plates.

Preferably each bifurcated assembly includes plural locking members, one from each part of the bifurcation, each adapted to prevent, when the locking members are deployed, weight plate removal or loss.

Preferably there is a bank of locking members positioned on one or both arms of the bifurcations.

Preferably the locking members can be paired across the gap, or staggered.

In a further aspect the present invention consists in exercising apparatus in combination with or carrying at least one weight plate.

Preferably the weight plate includes a mounting region by which it is capable of being mounted to the docking assembly.

In a further aspect the present invention consists in a set of weight plates each of a different weight ranging between 1 kg and 12 kg, said weight plates including a central mounting region by which each weight plate can be mounted to a docking assembly of a weight bar in a manner to allow the weight plate or plates so mounted to freewheel about an axis coincident with the axis of the weight bar, the weight distribution of at least one weight in the set of weight plates being such that it will bias, under the influence of gravity, the rotation of that weight plate towards one orientation about the axis.

Preferably each weight plate in said set of weight plates are substantially square or four sided in shape the sides being straight or curved.

Preferably at least the heaviest and preferably each weight plate in said set is non-circular in perimeter shape.

Preferably each weight plate is a multifaceted perimeter shape (preferably a polygonal and preferably 4 sides) each face being one selected from a straight side or curved side.

Preferably each weight plate is of a different plan shape.

Preferably each weight plate can be secured in a rotationally fixed manner to said docking assembly.

Preferably the docking assembly is engaged to a weight bar that can be grasped by a user, at least one of the bar and the docking assembly and the both the assembly of the docking assembly and bar being such that the docking assembly can rotate about said axis relative to the grasped portion of the weight bar.

Preferably the at least one weight plate having said weight distribution can, in use cause the docking assembly to rotate, thereby also rotating any other of the weight plates mounted to said mounting assembly.

Preferably said weight distribution of at least one weight in the set of weight plates is such that it will bias the rotation of that weight plate such that weight plate will return to a rotational position where one of said straight sides is parallel to the floor.

Preferably the weight distribution to bias said rotation is affected by a variation in weight distribution of the plate at or near the perimeter of the plate.

In a further aspect the present invention consists in exercise equipment comprising:

a weight bar, a set of weight plates each of a different weight ranging between 1 kg and 12 kg, said weight plates including a central mounting region by which each weight plate can be mounted to the end of said weight bar, wherein at least one weight plate of the set includes an aperture there through at and proximate the perimeter of the plate so as to define together with and at the perimeter of the plate a handle to allow the plate to be grasped by a user to lift the plate and the end of the bar at which said plate may be mounted.

Preferably each weight plate is also of a different plan shape.

Preferably each weight plate is of a round or multifaceted perimeter shape.

Preferably each weight plate has a notional outer diameter (irrespective of whether the perimeter or the weight plate is round or not) within which the weight plate extends.

Preferably each weight plate is shaped and configured such that when a plurality of said weight plates are mounted, in a stacked manner adjacent each other, the so mounted weight plate having the largest notional outer diameter presents its handle in a manner graspable by the user without the aperture of the weight plate being fully obstructed by an adjacent weight plate of the stack.

Preferably the at least one locking member is a toothed rack, where each tooth is moveable by a weight plate to allow a loading of the weight plate onto the docking assembly and each tooth can prevent unloading of the weight plate.

Preferably said toothed rack is shaped and configured so that each lock captures only one weight plate.

In a further aspect the present invention consists in a mount for releasably securing at least two weight plates to a weight plate lifting bar comprising:

a jaw defining member engaged or engageable to said bar and that can serially receive a mounting portion of each at least two weight plates, and a plurality of locking members moveably mounted by said jaw defining member in a manner to allow loading of said weight plates yet selectively capture said weight plates to said jaw defining member.

Preferably said plurality of locking members are presented as an array of movable teeth wherein between each adjacent pair of teeth of said array, one (and preferably only one) of said mounting portion can be located for weight plate capture to said jaw defining member by said pair of teeth.

Preferably said locking members are moveable, during loading of a said weight plate to said jaw defining member, by said weight plate.

Preferably said locking members are (a) moveable, during loading of a said weight plate to said jaw defining member, by said weight plate and (b) configured to be in a state immovable by said weight plate once loaded.

Preferably said locking members are configured to be in a state immovable by at least one selected from (i) a movement lock operative on the locking members that selectively prevents their movement and (ii) the shape of the locking members.

Preferably said locking members are presented to act in a ratchet like manner with said mounting portion.

Preferably the shape of the locking members only, prevents their movement by said weight plate once a weight plate is loaded, there being an actuator to move said locking members to allow said weight plate to be freed from capture.

In a further aspect the present invention consists in an exercise system comprising at least two weight plates and a weight plate lifting bar wherein secured to said lifting bar is a jaw defining member engaged or engageable to said bar and that that can serially receive a mounting portion of each at least two weight plates and wherein a plurality of locking members are moveably mounted by said jaw defining member in a manner to allow loading of said weight plates yet selectively capture said weight plates to said jaw defining member.

As used herein "bifurcated" does not rule out more than two regions of the assembly between which a region of a weight plate is to be positionable.

In another aspect the present invention consists in a docking assembly for use with the exercise equipment/weight training system as herein before described.

In another aspect the present invention consists in a weight plate for use with the exercise equipment/weight training system as herein before described.

In another aspect the present invention consists in a docking assembly as hereinbefore described with reference to any one or more of the accompanying drawings.

In another aspect the present invention consists in a weight plate as hereinbefore described with reference to any one or more of the accompanying drawings.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which:

FIG. 27 shows a second size of weight plate suitable for use with the weight training device of the present invention and shows the location of the cross section F-F.

FIG. 28 shows the cross section F-F of FIG. 27.

FIG. 29 shows a perspective view of the weight plate of FIG. 27.

DETAILED DESCRIPTION OF THE PREFERRED EMBODIMENTS

Figure 1:
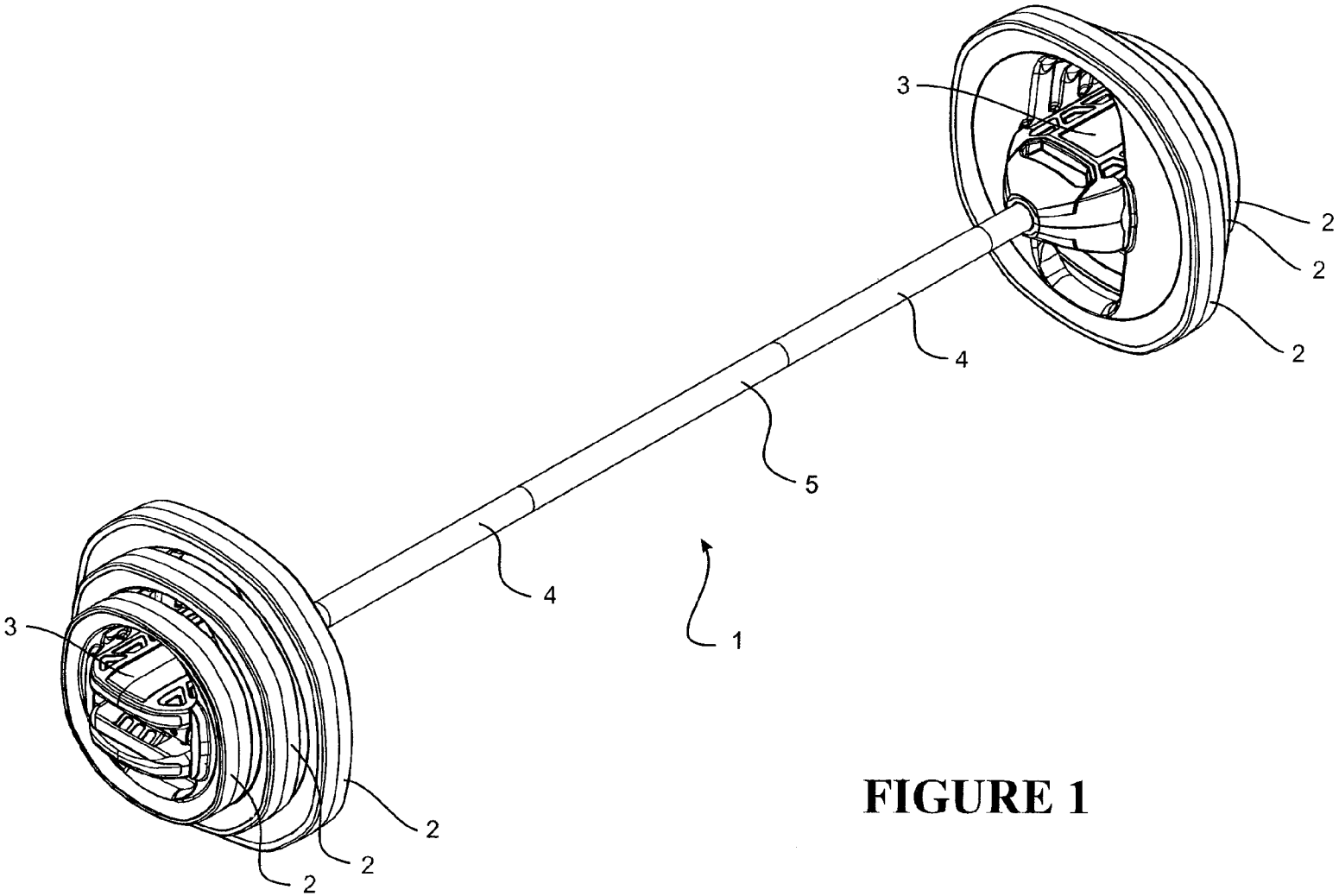
FIG. 1 shows a weight training device with weight plates attached thereto.
Figure 2:
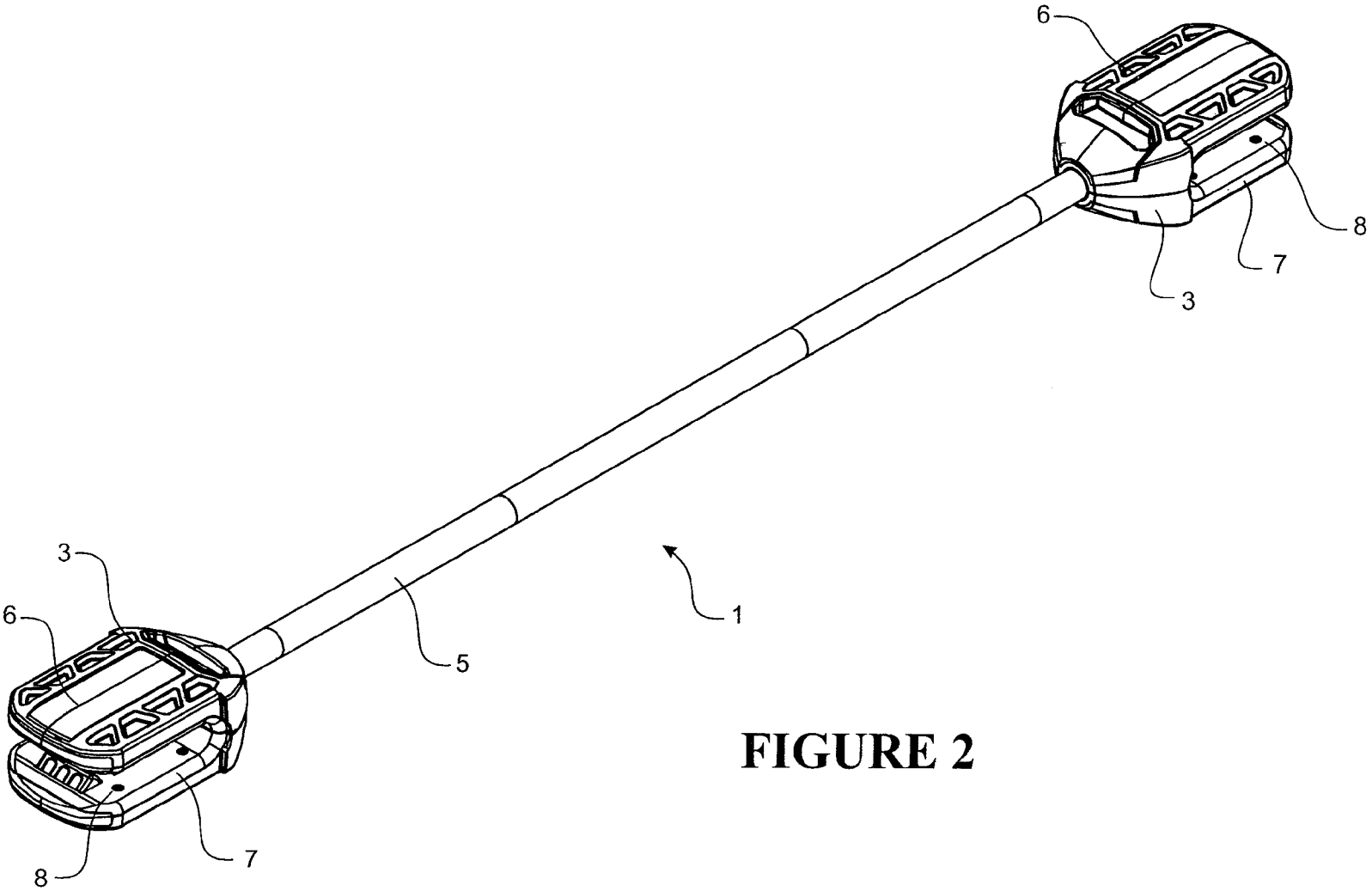
FIG. 2 shows the weight training device of FIG. 1 without weight plates.
Figure 3:
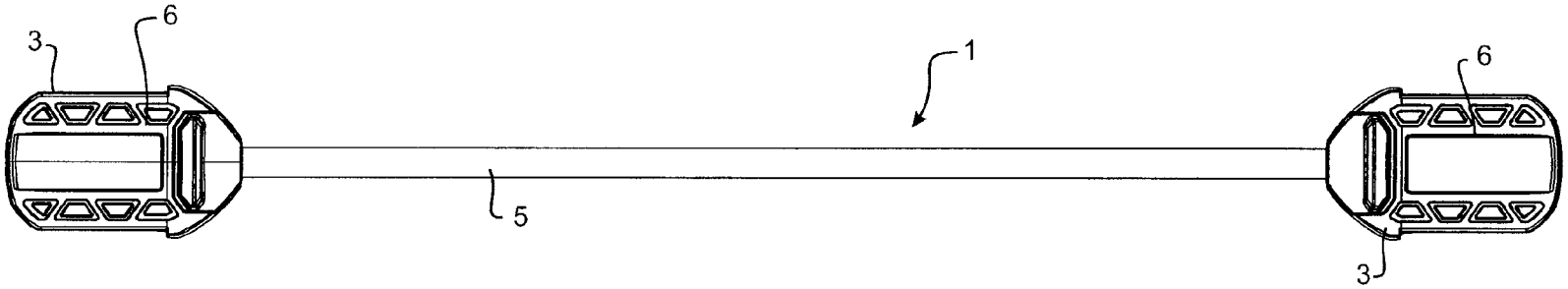
FIG. 3 shows a plan view of the weight training device of FIG. 2.
Figure 4:
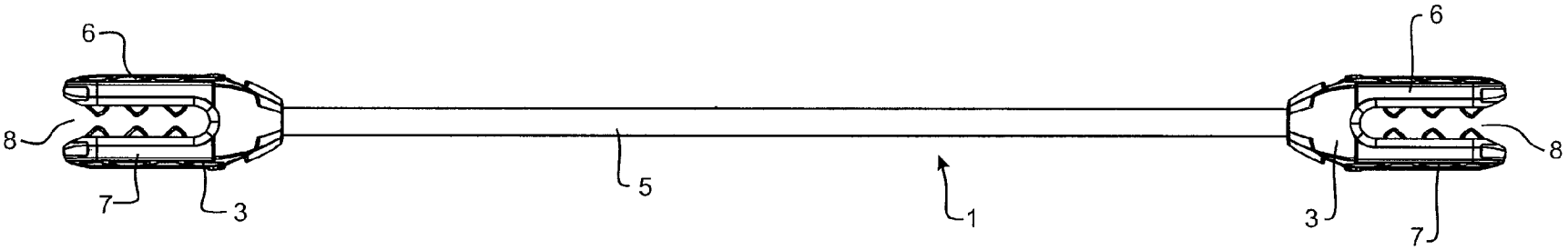
FIG. 4 shows a side view of the weight training device of FIG. 2.
Figure 5:
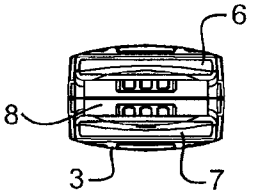
FIG. 5 shows an end view of the weight training device of FIG. 2.
Figure 6:
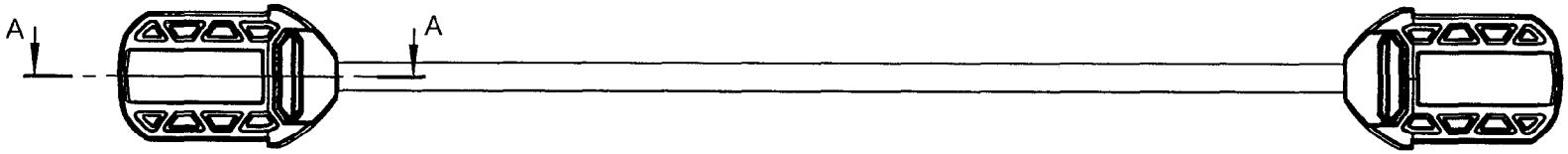
FIG. 6 shows a plan view of the weight training device of FIG. 2 and shows the location of the cross section A-A.

A weight training device 1 of the present invention is shown with reference to FIG. 1. The weight training device 1 is shown with weight plates 2 attached to docking assemblies 3. The docking assemblies 3 act as hubs for the weight plates 2 to be docked to. A user of the weight training device 1 may grip the weight training device 1 at a grippable region 4. In the preferred embodiment the grippable region 4 is a part of a bar 5.

The weight training device 1 may be adapted to allow for one or more weight plates 2 to be mounted at either end of the bar 5. This allows for the user of the weight training device 1 to vary the amount of weight carried by the bar 5 in accordance with their exercise regime. The docking assemblies 3 connected to either end of the bar 5 are designed to allow for quick attachment and detachment of the weight plates to allow a user to adjust the weight carried by the bar quickly and easily.

Docking Assembly

A weight training device 1 with no weights plates attached thereto is shown with reference to FIGS. 2 to 6. In the preferred embodiment, the weight training device 1 has a docking assembly or mount 3 attached to either end of the bar 5. Alternatively, a weight training device 1 may be provided with a single docking assembly or more than two docking assemblies.

The docking assemblies 3 are preferably a bifurcated assembly having upper and lower arms 6 and 7 respectively. The upper and lower arms are outwardly extending formations that define a slot 8 that extends into the docking assembly 3. The slot 8 is provided to receive the mounting region 12 of a weight plate 2. The slot 8 is suitably dimensioned to receive multiple weight plates 2 to dock the weight plates 2 to the docking assembly. In the most preferred embodiment of the invention, the slot 8 receives up to three weight plates 2.

Figure 7:
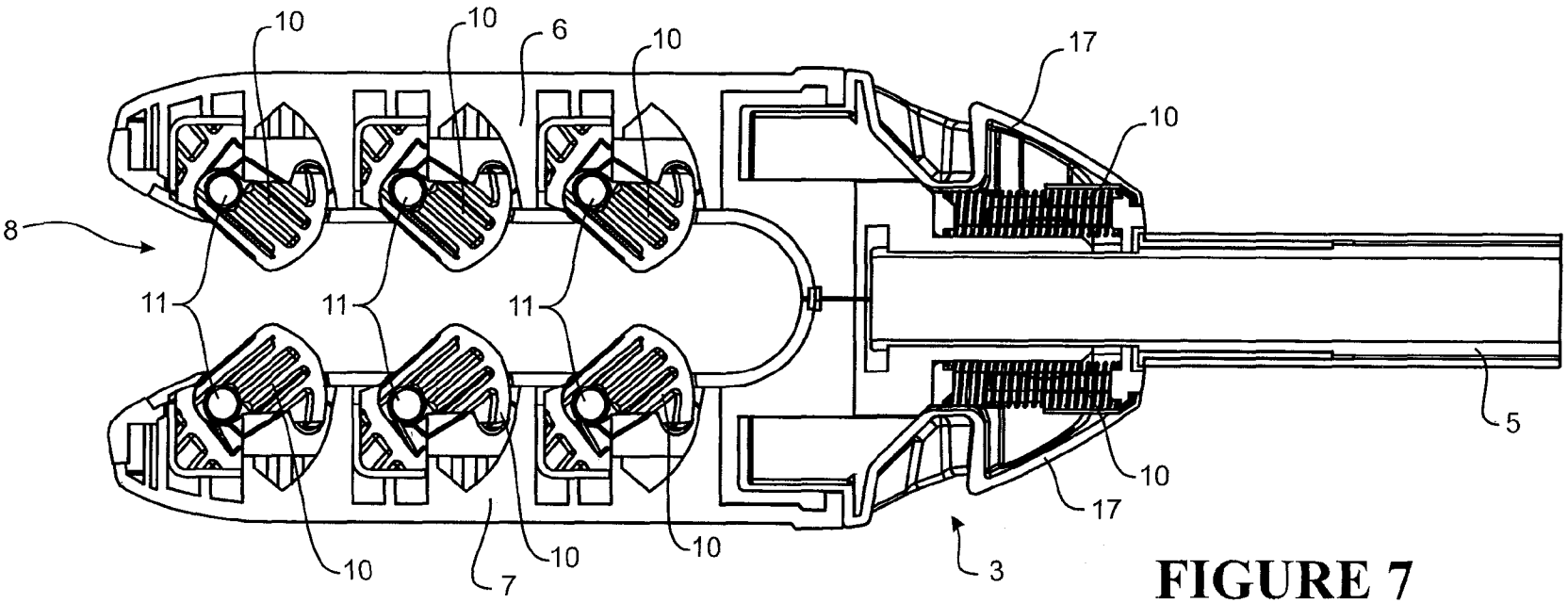
FIG. 7 shows the cross section A-A of FIG. 6.
Figure 8:
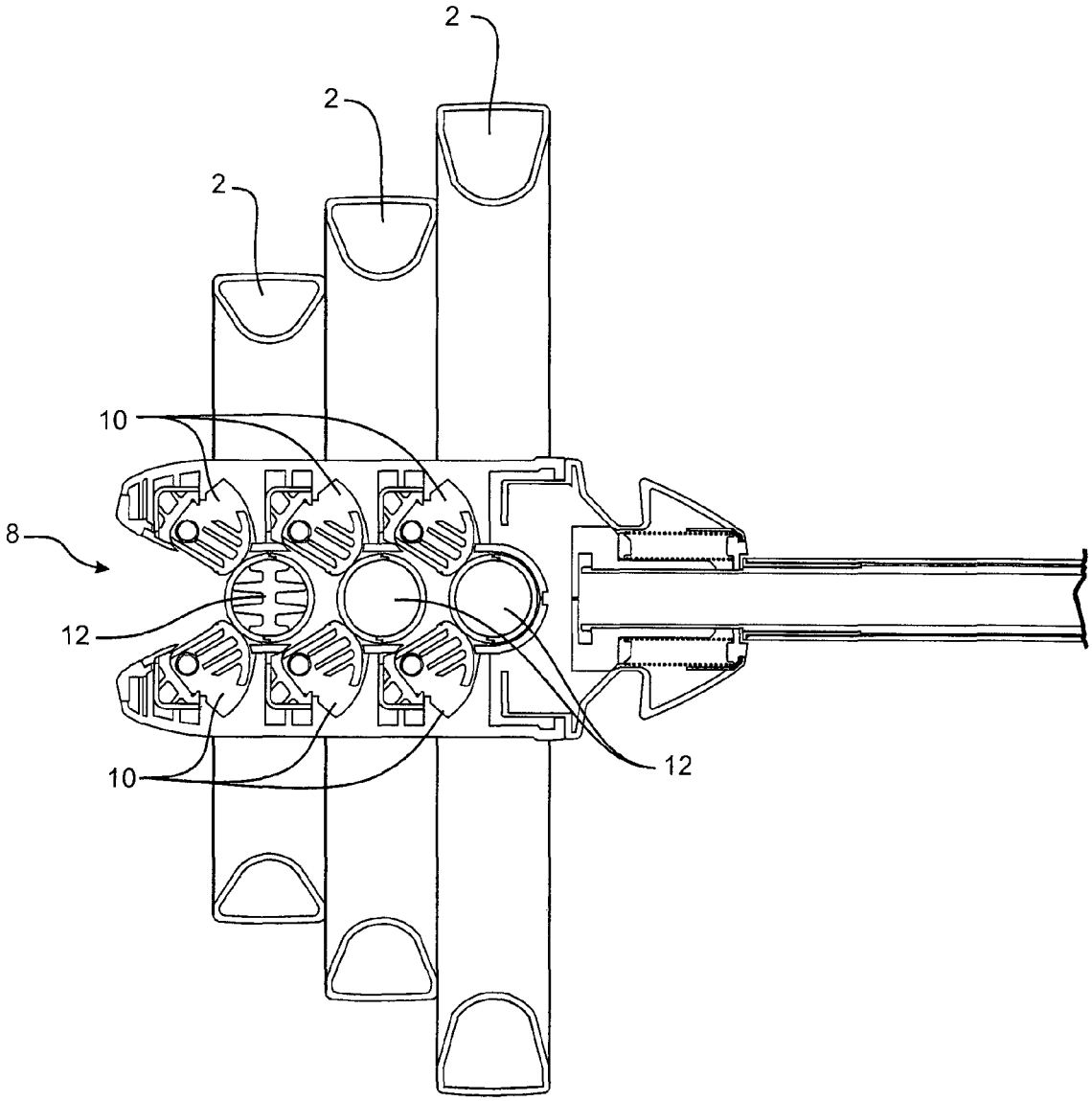
FIG. 8 shows a cross section view of a docking assembly with three weight plates locked to the docking assembly by the locking members.
Figure 9:
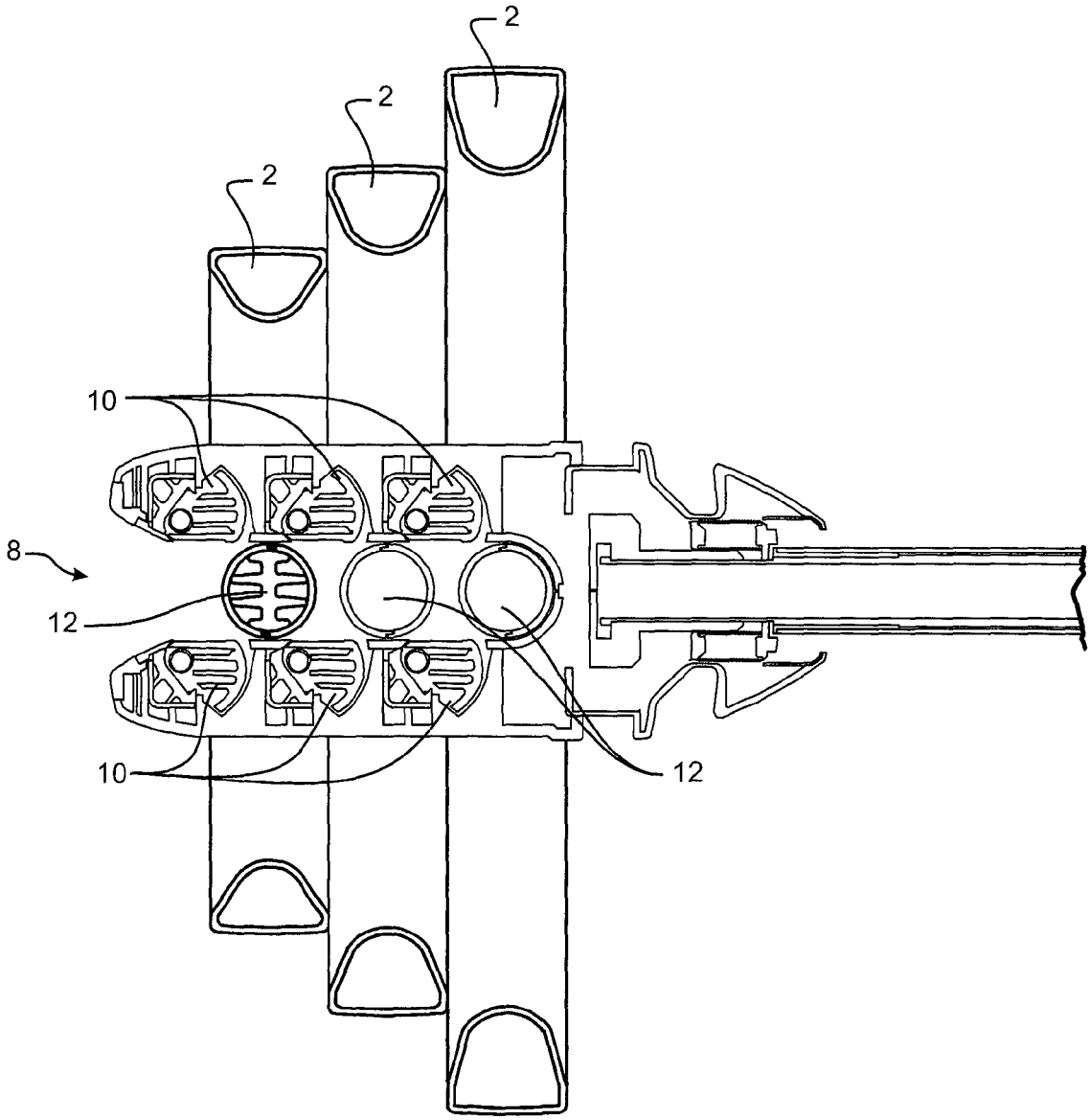
FIG. 9 shows a cross section view of a docking assembly with the locking members in the second, unlocked position so that the three weight plates may be removed from the slot of the docking assembly.

Locking members 10 are preferably provided from the upper arm 6 and the lower arm 7. The locking members are pivotally mounted to their respective arms and are able to pivot about pivots 11. The locking members 10 are able to capture a weight plate 2 inside the slot 8 as shown in FIG. 8. The locking members are moveable between two positions, a first locking position (as shown in FIGS. 7 and 8) and a second unlocked position (as shown in FIG. 9). When in the first locking position, a weight plate cannot be released from the slot 8. However, if no weight plates have been slid onto the docking assembly, a weight plate can be pushed over the locking members 10 and captured in the docking assembly by each respective locking member the plate is slid over. When in the second unlocked position, the locking members 10 are retracted substantially inside their respective arms so that the mounting region 12 of the weight plate 2 can be released from the slot 8 to allow removal of the weight plate 2 from the docking assembly 3.

The locking members 10 are biased to the first locking position as shown in FIGS. 7 and 8. Preferably a torsion spring 13 (see FIG. 10) is provided to bias each locking member to the first locking position. It should be appreciated that any other alternative means of biasing the locking member to the first locking position may be employed.

When the mounting region 12 of a weight plate 2 is slid into the slot 8, the mounting region 12 pushes against the locking members 10 so that the locking members 10 pivot, against their bias, about the pivots 11. As they are pivoted against their bias they retract inside their respective arms 6 and 7 so that the mounting region 12 may be received deeper inside the slot 8. Once the mounting region 12 has been pushed beyond a pair of locking members 10, they will be biased back into their first locked position and therefore the weight plate is captured and prevent the removal of the mounting region 12 of the weight plate 2 from the slot 8.

As is evident from FIG. 8, a first weight plate 2 would have to be pushed beyond three pairs of locking members 10 in order to be positioned at the deepest position inside the slot 8 of the docking assembly 3. A second weight plate would have to be pushed beyond two pairs of locking members 10 in order to be positioned adjacent to the first weight plate. A third weight plate 2 would have to be pushed beyond only one pair of locking members to be positioned adjacent to the second weight plate. In this way, it is possible to locate up to three weight plates 2 inside the slot 8 of the docking assembly 3. It should be appreciated that the docking assembly 3 may have a deeper slot and include further pairs of locking members 10 to enable receipt of more than three weight plates 2. Likewise, the slot may be shallower, and include fewer pairs of locking members to enable receipt of less than three weight plates 2.

Figure 10:
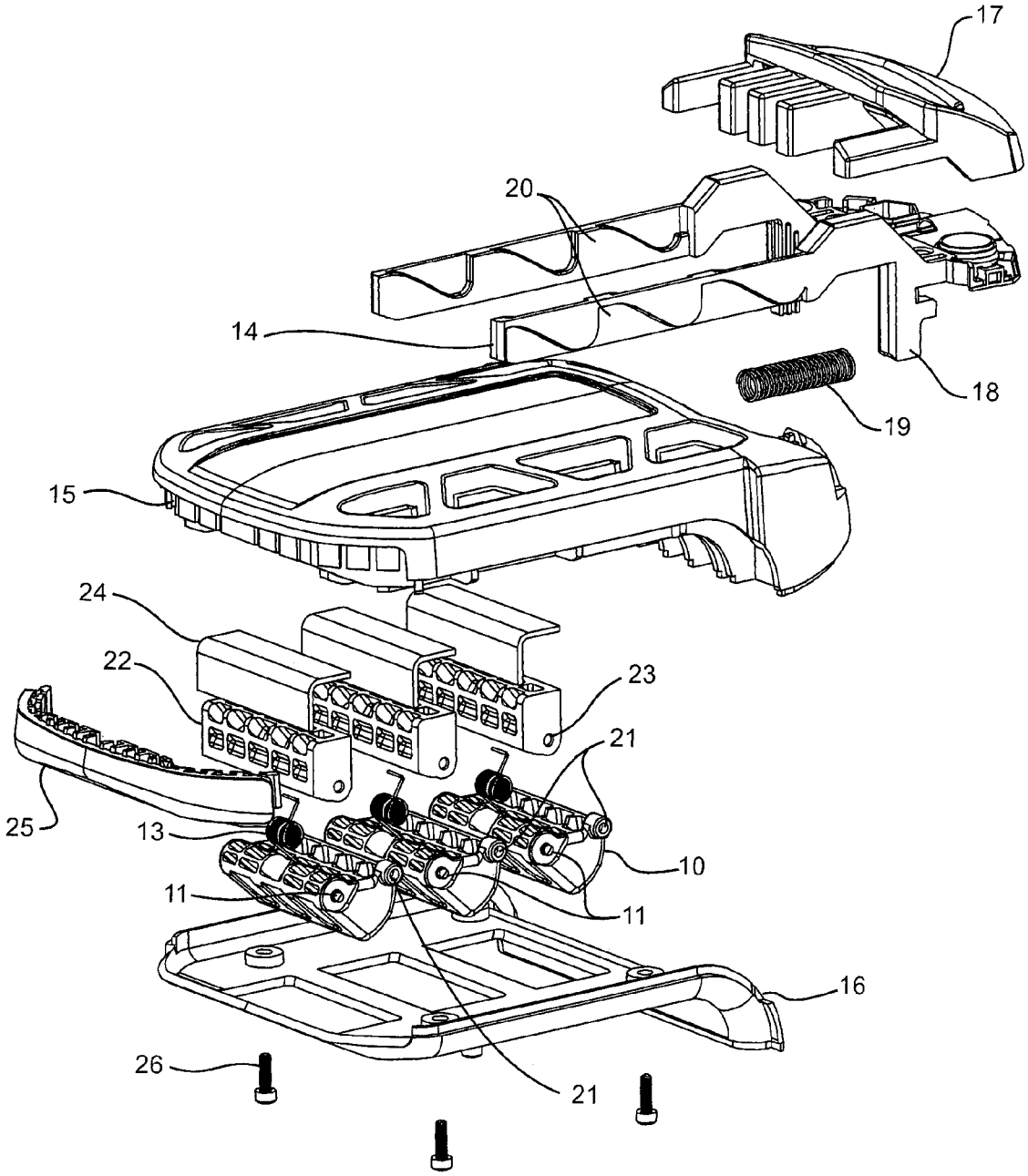
FIG. 10 shows an exploded view of the assembly of the upper arm of the docking assembly.
Figure 11:
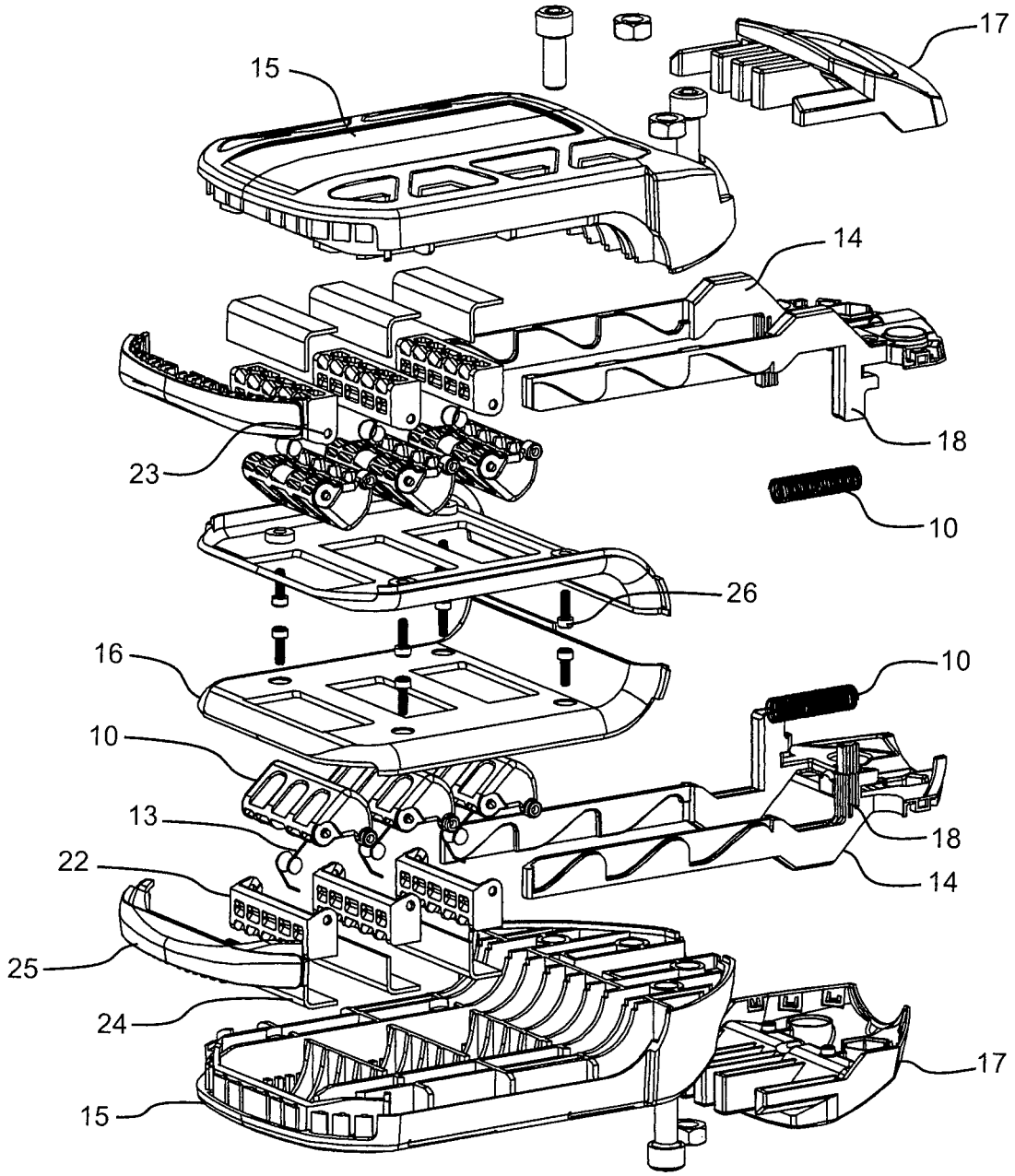
FIG. 11 shows an exploded view of the assemblies of both the upper and lower arms of the docking assembly.

The locking members 10 are preferably positioned in a relationship with cam sockets 22. The cam sockets 22 provide apertures 23 through which pivots 11 of the locking members 10 are pivotally coupled. Cam socket pads 24 are also provided as part of the assembly. The assembly also includes a bumper 25, preferably made from a rigid plastic material. The bumper 25 provides some impact resistance for the docking assembly. As shown in FIGS. 10 and 11 screws are provided to secure the assemblies together.

Once the mounting region 12 of the weight plate(s) is held captive by the locking members inside the slot 8, they can only be removed by pivoting the locking member 10 to the second unlocked position. The locking members 10 can then be moved to the second unlocking position by manipulation of an actuator 14. An actuator 14 is provided to be moveable in a linear direction with respect to the outer housing 15 and the inner housing 16 of the upper and lower arm members 6 and 7. The actuator 14 is coupled to a release catch 17 than can be manipulated by a user of the weight training device 1 in order to effect linear movement of the actuator 14. As shown on FIG. 11, the actuator 14 of the upper arm 6 is preferably coupled to the actuator 14 of the lower arm 7 so that they can move in unison. Coupling of the actuators 14 may be achieved by connecting portions 18 engaging one another.

The release catch 17 coupled to each actuator 14 can be pulled back to effect linear movement of the actuator 14. A spring 19 biases the release catch 17 and the actuator 14 towards the docking assembly housing, to the locked position as shown on FIGS. 7 and 8. Pulling the release catch 17 moves the actuator against the bias of the spring 19.

The actuator 14 has a translating cam profile 20 corresponding with each locking member 10. The translating cam profile 20 (see FIG. 10) engages with a follower 21 located on each locking member 10. The relationship between the cam profile 20 and the follower 21 is such that linear movement of the actuator 14 causes the locking member 10 to pivot about pivot 11 as the follower 21 is moved by the translating cam profile 20. Therefore when the release catch 17 is pulled in a direction away from the docking assembly housing, the followers 21 are affected by the cam profile of the actuator 14 to cause the locking members to pivot and retract within the housing of the docking assembly 3. This allows for any mounting region 12 of a weight plate 2 to be released from the slot 8 of the docking assembly 3. This is the process for unlocking weight plates that were located on the weight training device 1. In use, a user may pull the release catch 17 and slide out the weight plates 2 or "tip" the weight plates out of the docking assembly 3.

Figure 14:
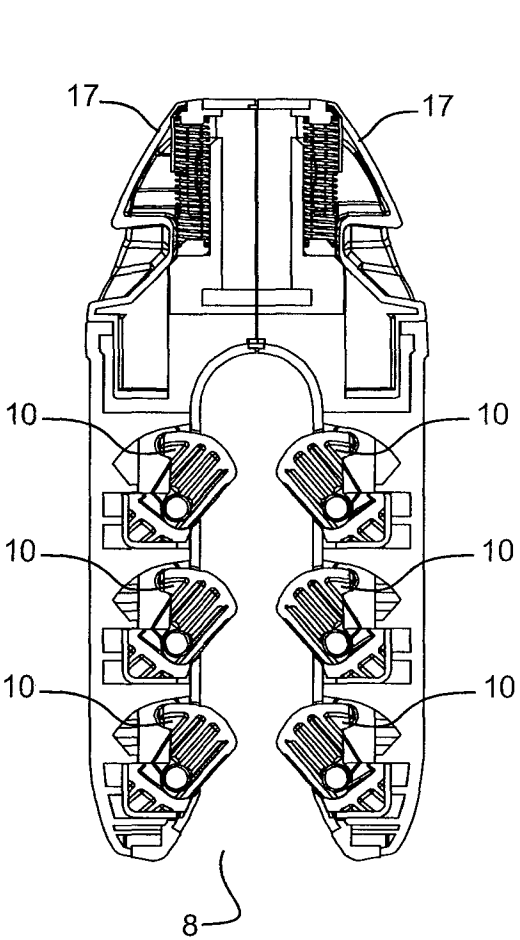
FIG. 14 shows the cross section B-B of FIG. 12.
Figure 13:
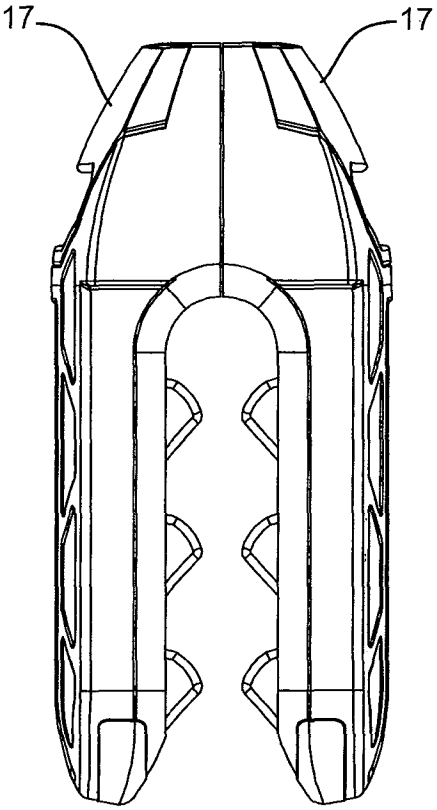
FIG. 13 shows a side view of the docking assembly of FIG. 12.
Figure 12:
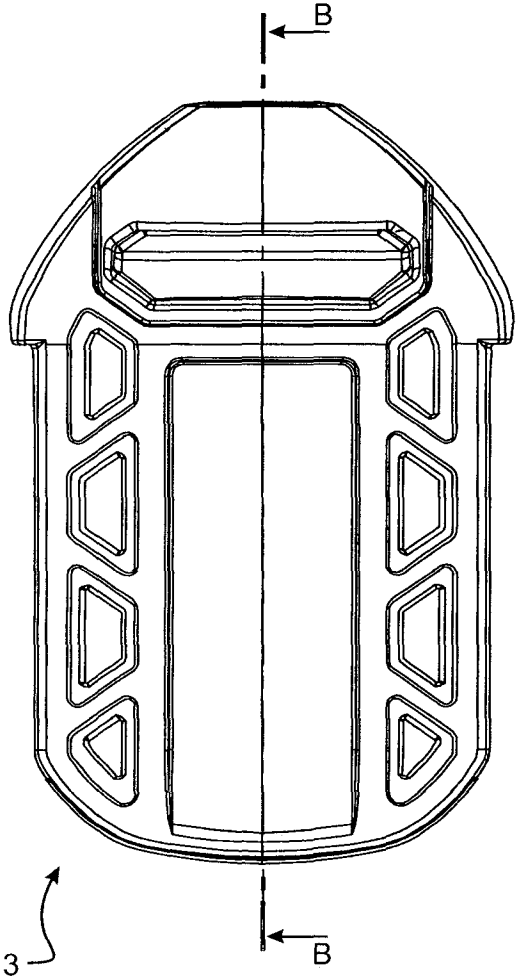
FIG. 12 shows a plan view of a docking assembly for a weight training device with the locking members in the locked position and shows the location of the cross section B-B.

FIGS. 12 to 14 show a docking assembly 3 in the locked position. In this position, the locking members 10 would lock the mounting region 12 of a weight plate to the docking assembly 3.

Figure 17:
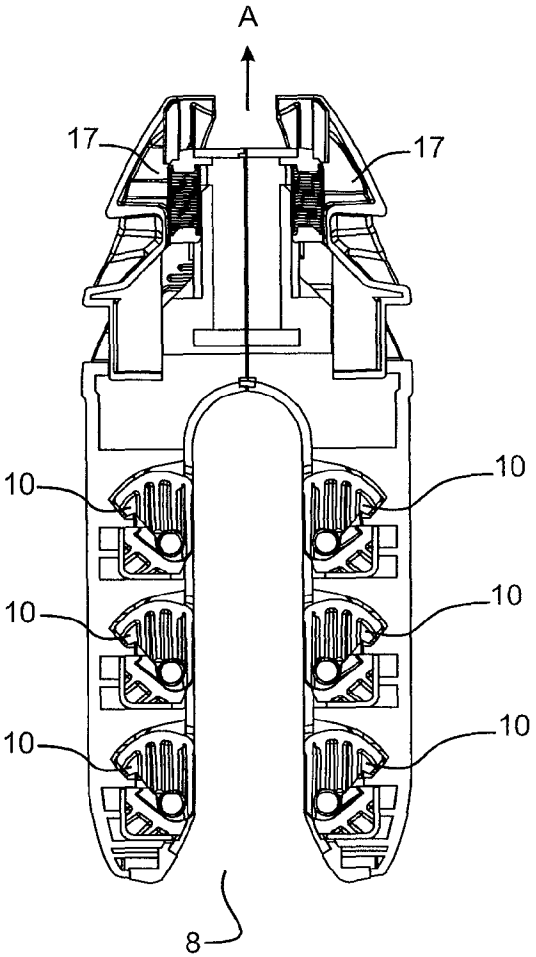
FIG. 17 shows the cross section C-C of FIG. 15.
Figure 16:
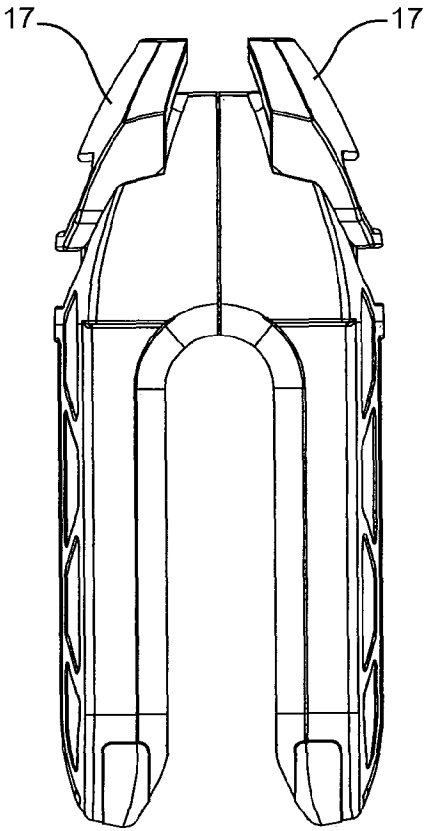
FIG. 16 shows a side view of the docking assembly of FIG. 15.
Figure 15:
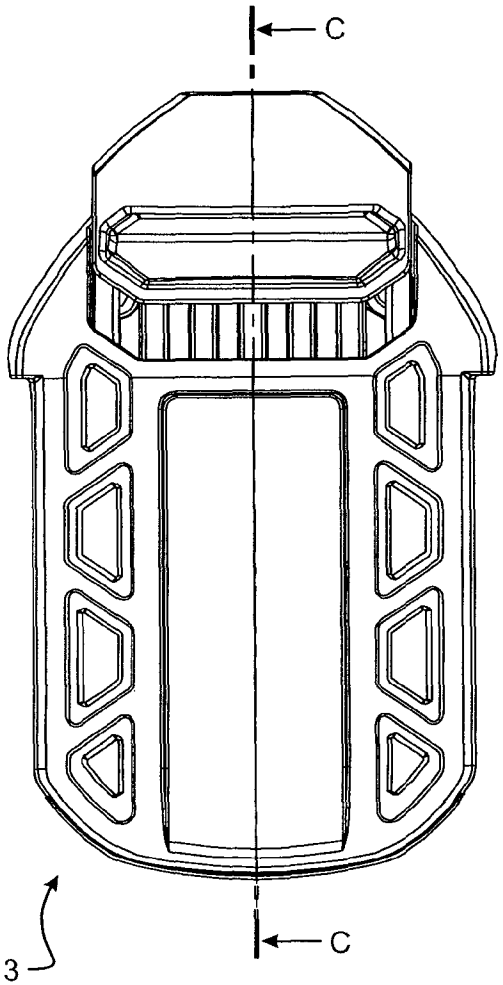
FIG. 15 shows a plan view of a docking assembly for a weight training device with the locking members in the unlocked position and shows the location of the cross section C-C.

FIGS. 15 to 17 show a docking assembly 3 in the unlocked position. By sliding the release catch 17 in the direction of arrow 'A' the locking members 10 are retracted inside the docking assembly housing to clear the slot 8 and allow the mounting region 12 of a weight plate to be removed.

Figure 36:
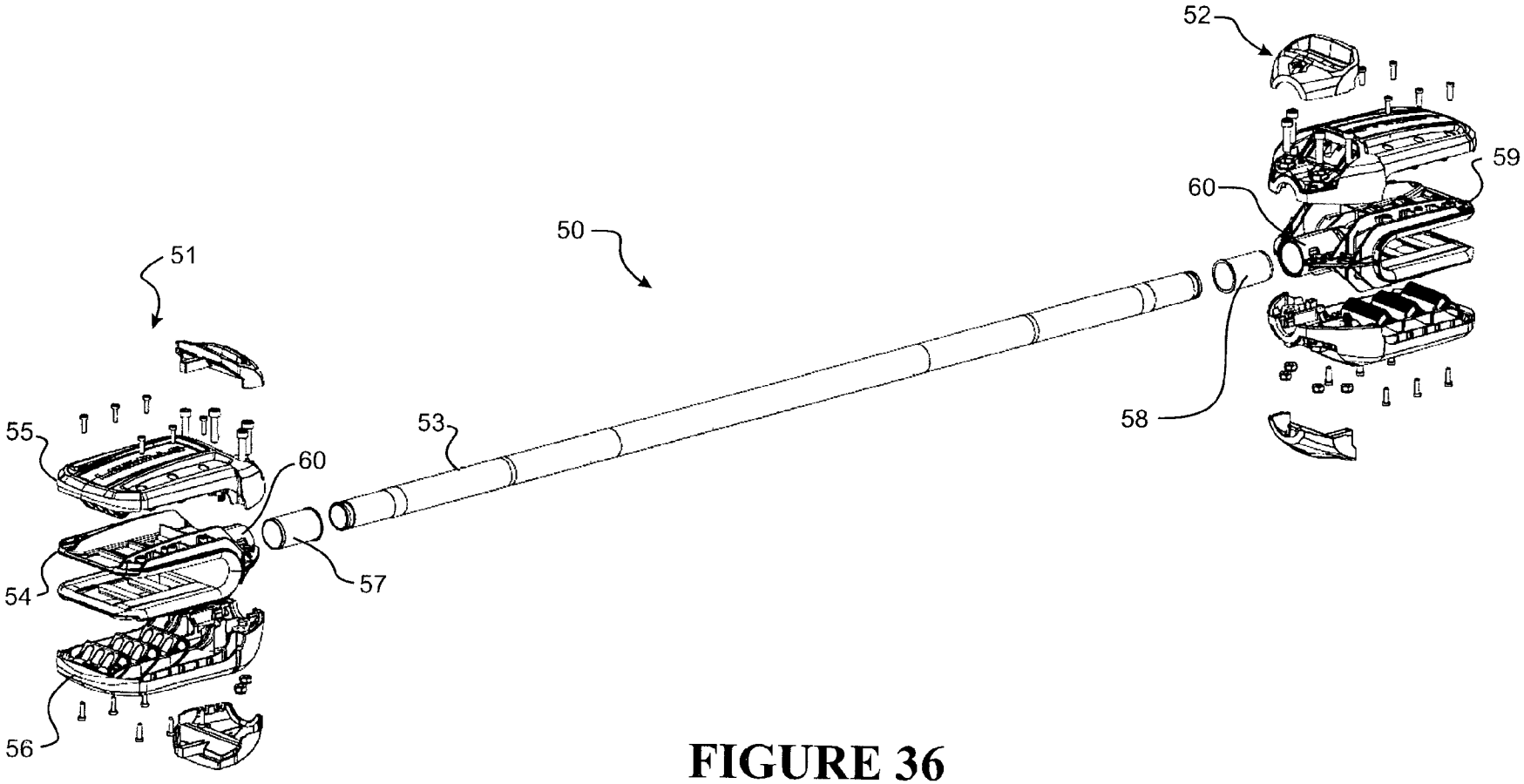
FIG. 36 shows an exploded view of a second preferred embodiment of a weight training device.

FIG. 36 shows another preferred embodiment of a weight training device 50. As with the embodiment described above, this weight training device has a docking assembly 51, 52 attached to either end of the bar 53. Each of the docking assemblies 51, 52 is similar to that described above in that the locking members are constructed and work in the same way. However, the bifurcated arms differ in that instead of separate inner housings 16 (see FIG. 10) fixed together for each docking assembly, the inner housing 54, 59 in the embodiment of FIG. 36 of the upper and lower arm members is a single bifurcated housing. The outer housings 55, 56 are substantially the same as described above with reference to FIG. 10.

It should be appreciated that the various components of the docking assembly can be manufactured from any suitable components as would be apparent to a person skilled in the art.

Bar

Figure 18:
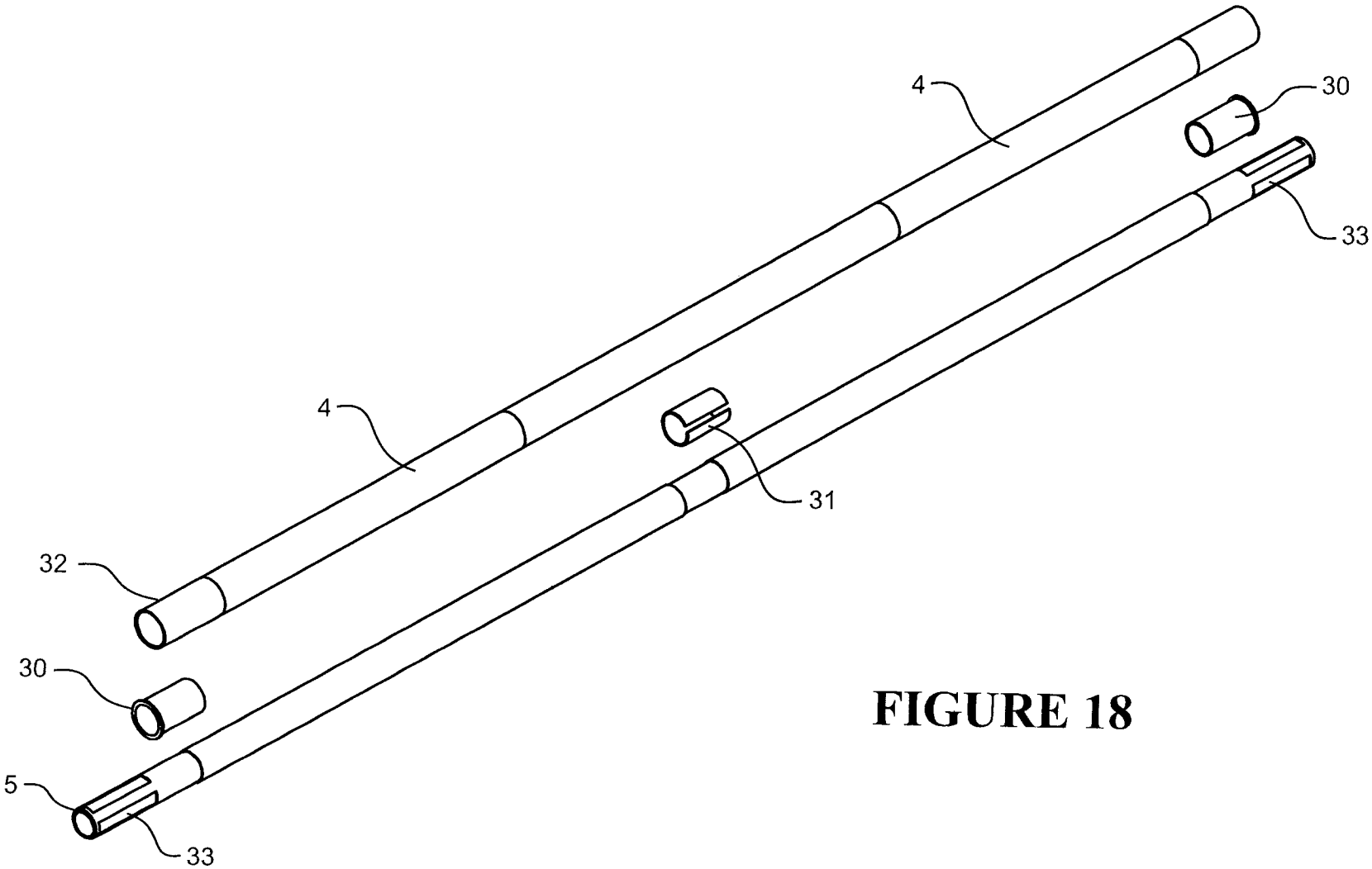
FIG. 18 shows an exploded view of the bar assembly.

An exploded view of one embodiment of the bar assembly is shown in FIG. 18. The bar 5 has end bushes 30 and a central bush 31 located thereon. The bushes 30 and 31 allow for the bar grip 32 to engage with the bar 5 in a manner such that it can rotate independently of the bar 5. This allows the bar and weight plates to rotate relative to the user, in use. The bar grip 32 includes grippable regions 4. The bar 5 is preferably steel. The bar grip 32 is preferably chromed or stainless steel. The bushes 30 and 31 are preferably acetal. It should be appreciated that these components may be manufactured from any other suitable materials.

Figure 19:
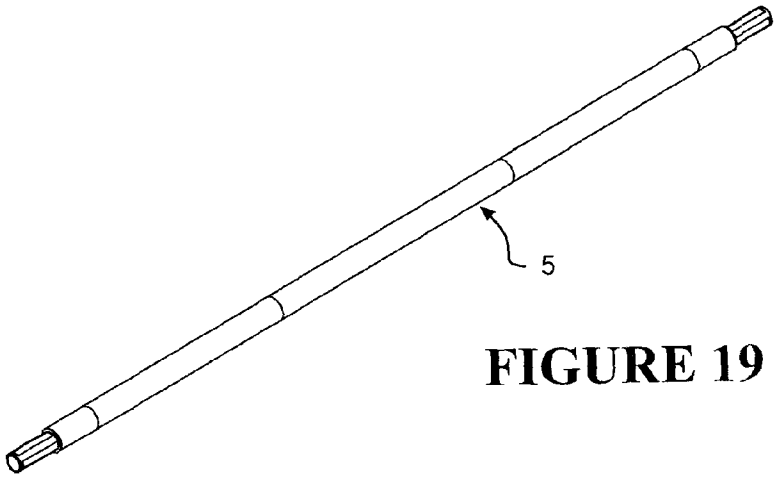
FIG. 19 shows a perspective view of the bar assembly.
Figure 20:
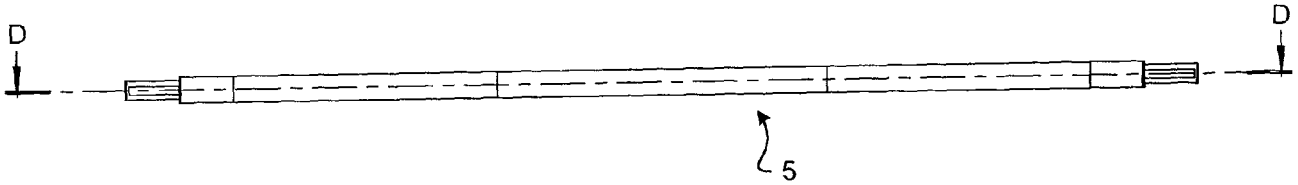
FIG. 20 shows a top view of the bar assembly and shows the location of the cross section D-D.
Figure 21:
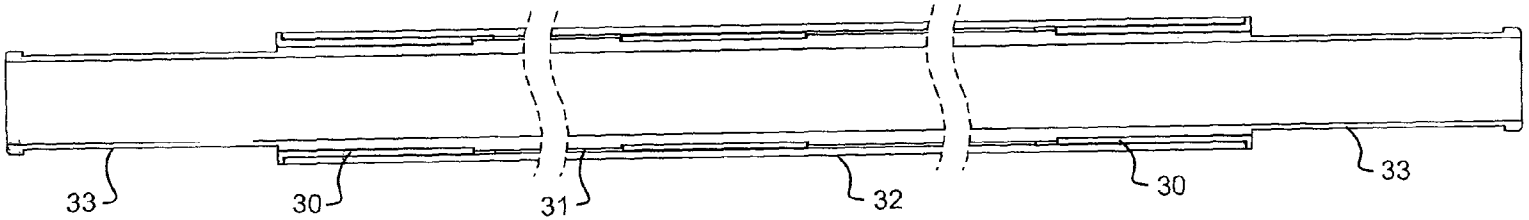
FIG. 21 shows the cross section D-D of FIG. 20.

FIGS. 19 to 21 show the bar assembled. FIG. 21 in particular shows the construction of the bar and shows the bushes 30 and 31 which facilitate rotational movement of the outer bar grip 32 with respect to the bar 5.

Figure 22:
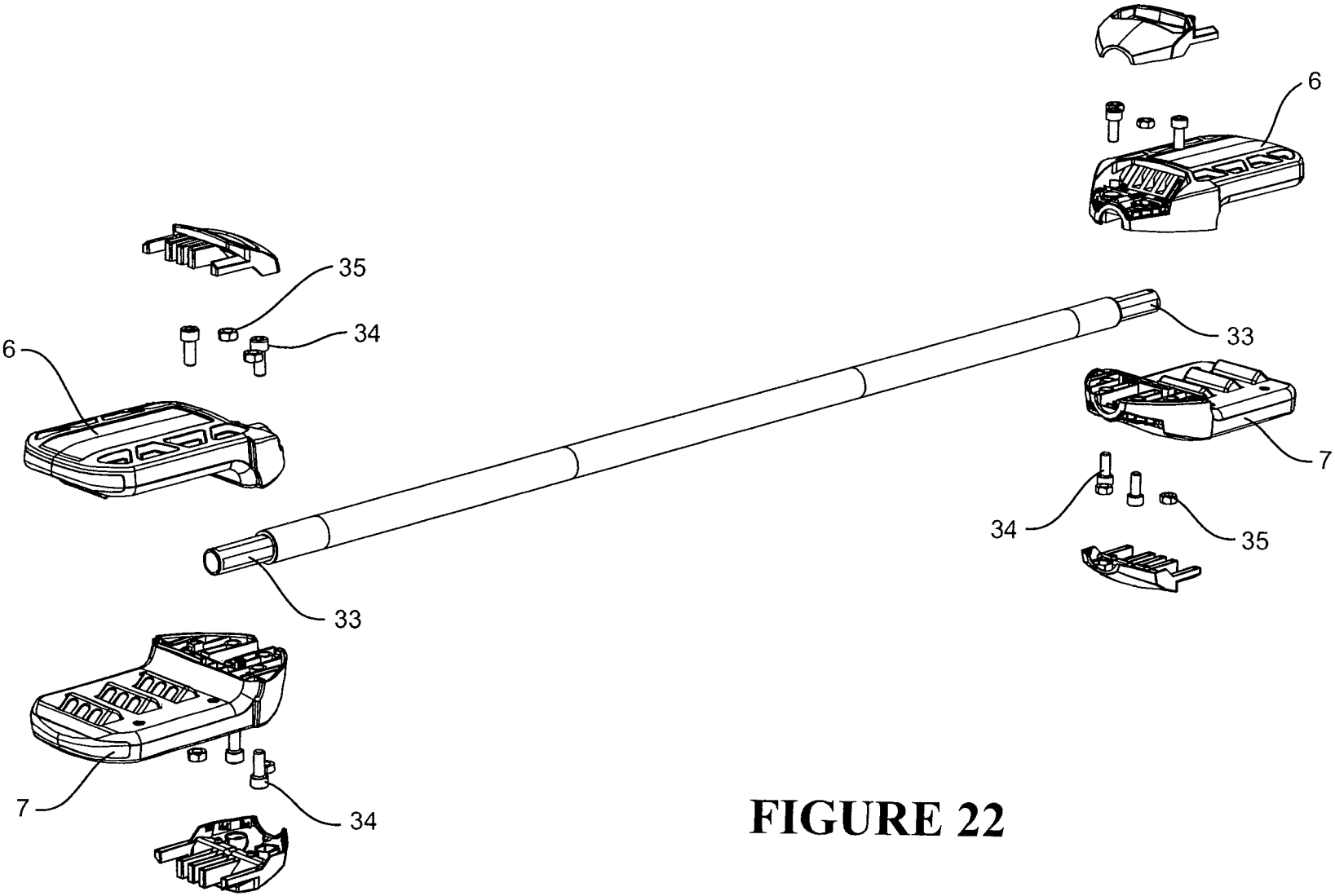
FIG. 22 shows an exploded view of the weight training device assembly.

The end regions 33 of the bar 5 may engage with the docking assembly 3 as shown in FIG. 22. As shown, the end regions 33 are sandwiched between the upper arm 6 and the lower arm 7 of each docking assembly 3. Screws 34 and nuts 35 may hold the assembly together. The end region 33 of the bar may be splined so that it cannot rotate relative to the docking assembly 3 when engaged thereto. Alternatively the bar may be coupled to the docking assembly in any suitable way as would be apparent to a person skilled in the art.

FIG. 36 shows another preferred embodiment of a bar 53 for a weight training device 50. Here the bar 53 is a single bar, not a double bar as described above with reference to FIGS. 18 to 21. The bar 53 has bushes 57, 58 at each end that are fixed into sleeves 60, 61 formed on each inner housing 54, 59 of the docking assemblies. The bar 53 is attached the bushes 57, 58 and the inner housings 54, 59, for example, by way of a circlip, such that the interaction of the bushes and rod means the docking assemblies can rotate relative to the bar 53. This allows a certain amount of "freewheeling" of the weight plates and docking assemblies, in use, when a user is lifting the bar (with weight plates). This provides ease of use during exercises utilising the weight training device.

Weight Plates

Figure 23:
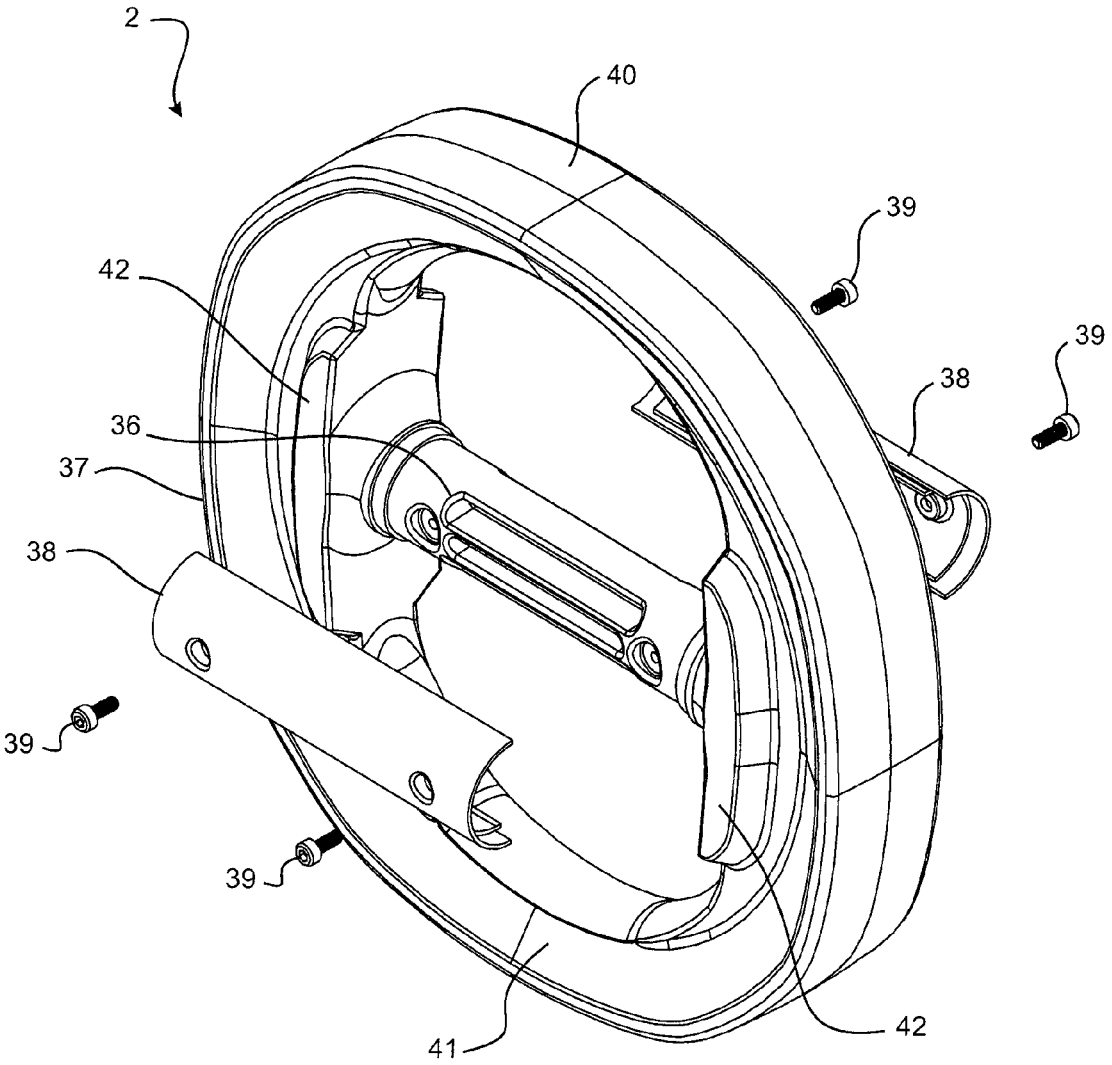
FIG. 23 shows an exploded view of a weight plate assembly.

FIG. 23 shows one embodiment of a weight plate assembly. The assembly consists of a weight plate core 36 which is preferably cast from steel. A plastic outer shell 37 is preferably provided over the exterior of the core 36. It should be appreciated that any suitable materials may be used for the weight plate core and outer shell.

A handle 38 preferably covers the core 36 to define a mounting region 12 that bisects the weight plate. The handle 38 is secured to the core 36 via screws 39. The handle 38 functions as a grippable region for a user and also as the mounting region 12, i.e. the region at which the weight plate 2 can be mounted inside the slot 8 of the docking assembly 3. A user may also grip the weight plate at gripping regions 40 and 41.

The weight plate 2 includes support faces 42 that preferably butt against the support faces 42 of adjacent weight plates to help ensure the pitch between the weight plates is maintained when a plurality of weight plates are located on a docking assembly 3. The support faces 42 also butt against a portion of the docking assembly housing. This is to ensure that, in the instance where only one weight plate is located on the docking assembly 3, it is maintained in an orientation such that the plane of the weight plate is substantially perpendicular to the elongate direction of the bar.

Figure 24:
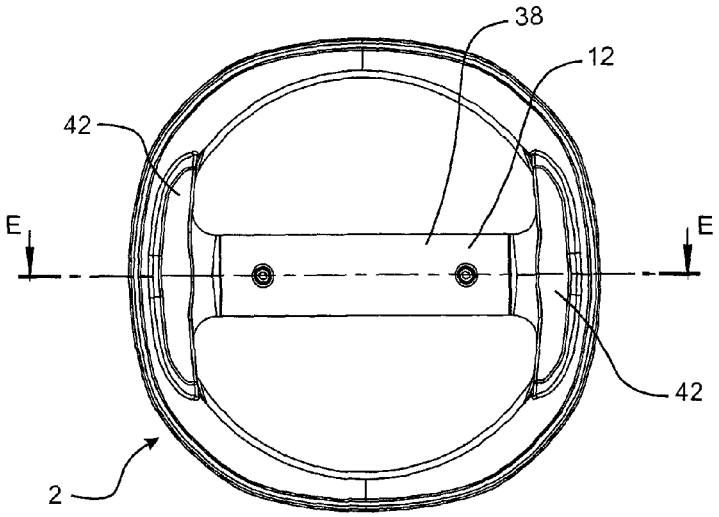
FIG. 24 shows a first size of weight plate suitable for use with the weight training device of the present invention and shows the location of the cross section E-E.
Figure 25:
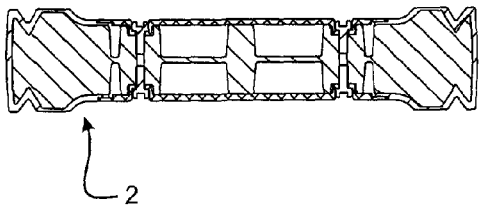
FIG. 25 shows the cross section E-E of FIG. 24.
Figure 26:
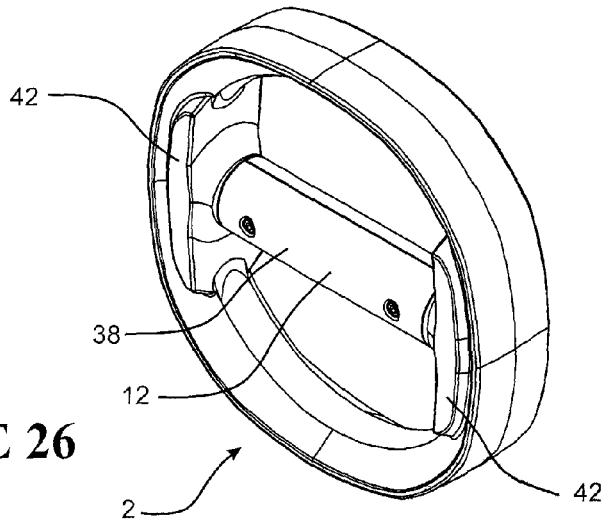
FIG. 26 shows a perspective view of the weight plate of FIG. 24.

FIGS. 24 to 26 show a weight plate that may be a 1 kg weight plate for example.

FIGS. 27 to 29 show a weight plate that may be a 2.5 kg weight plate for example.

Figure 30:
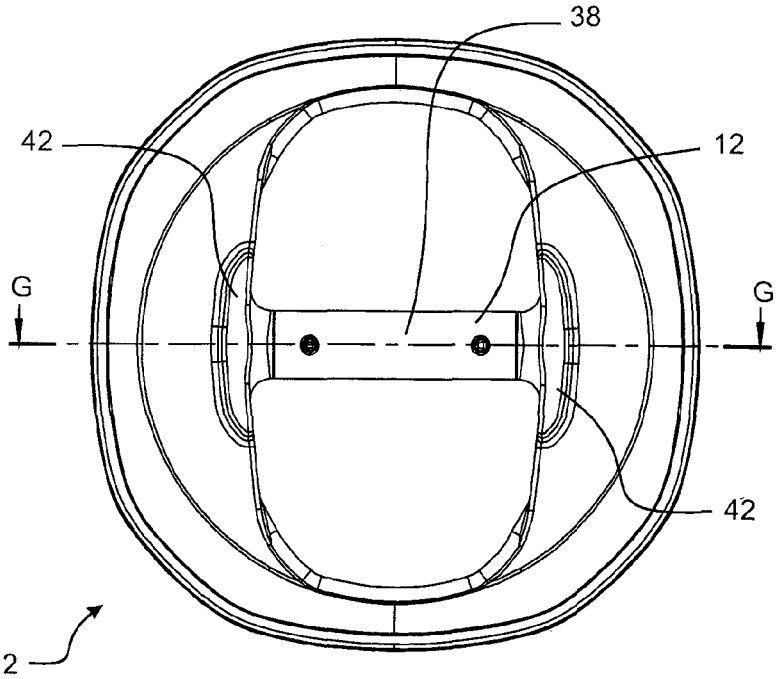
FIG. 30 shows a third size of weight plate suitable for use with the weight training device of the present invention and shows the location of the cross section G-G.
Figure 31:
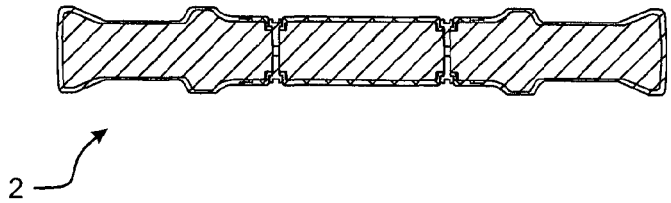
FIG. 31 shows the cross section G-G of FIG. 30.
Figure 32:
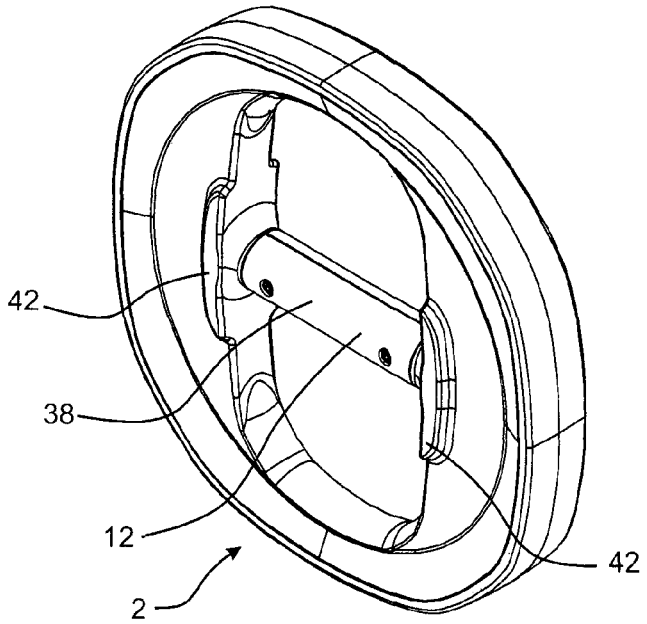
FIG. 32 shows a perspective view of the weight plate of FIG. 30.

FIGS. 30 to 32 show a weight plate that may be a 5 kg weight plate for example.

Figure 33:
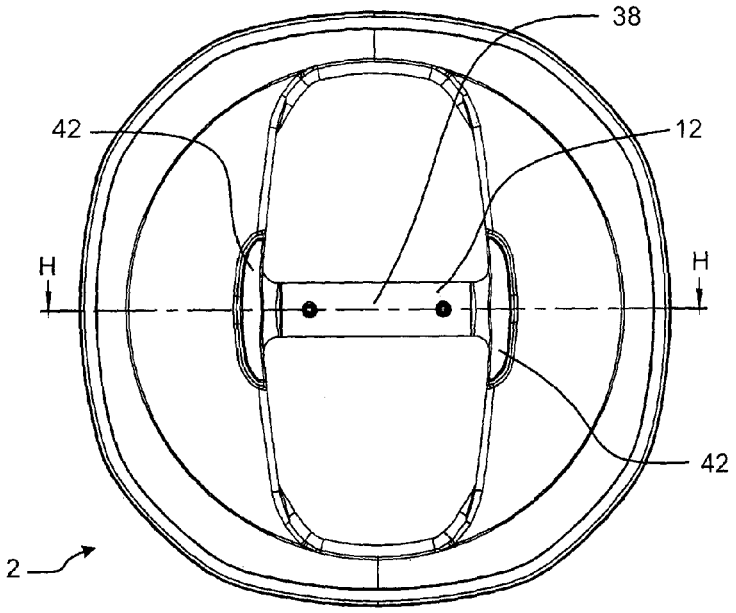
FIG. 33 shows a fourth size of weight plate suitable for use with the weight training device of the present invention and shows the location of the cross section H-H.
Figure 34:
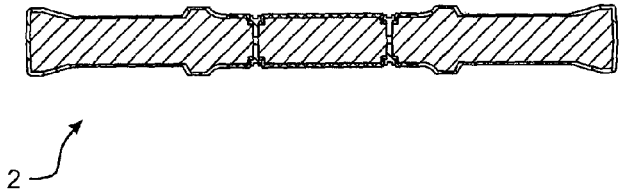
FIG. 34 shows the cross section H-H of FIG. 32.
Figure 35:
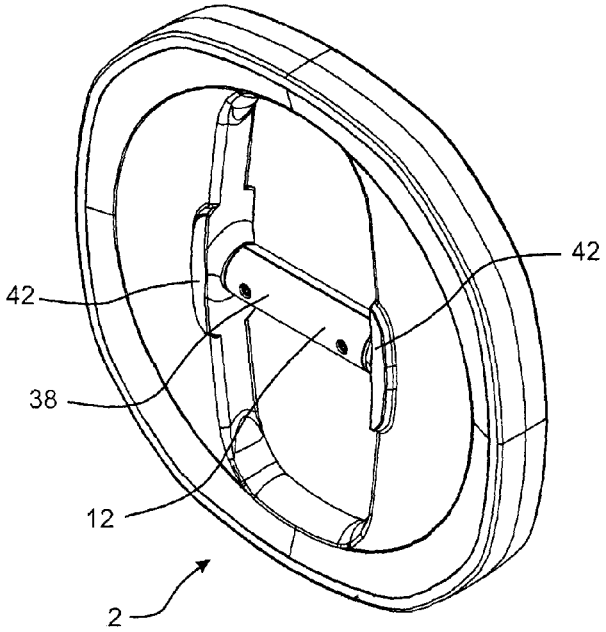
FIG. 35 shows a perspective view of the weight plate of FIG. 32.

FIGS. 33 to 35 show a weight plate that may be a 10 kg weight plate for example.

In the preferred weight training system it is preferred that the bar and docking assemblies are provided with a set of weights, for example a pair of each of 1 kg, 2.5 kg and 5 kg weight plate. Optionally, the system may be supplied with a 10 kg weight plate, again, similar to any of those described herein.

Figure 40:
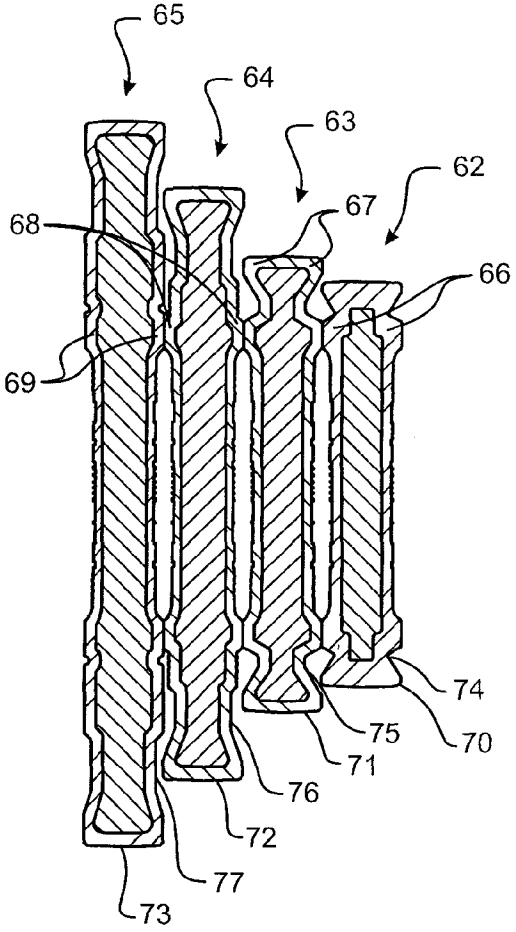
FIG. 40 shows a cross sectional view through I-I in FIG. 39 of the stacked weight plates.
Figure 39:
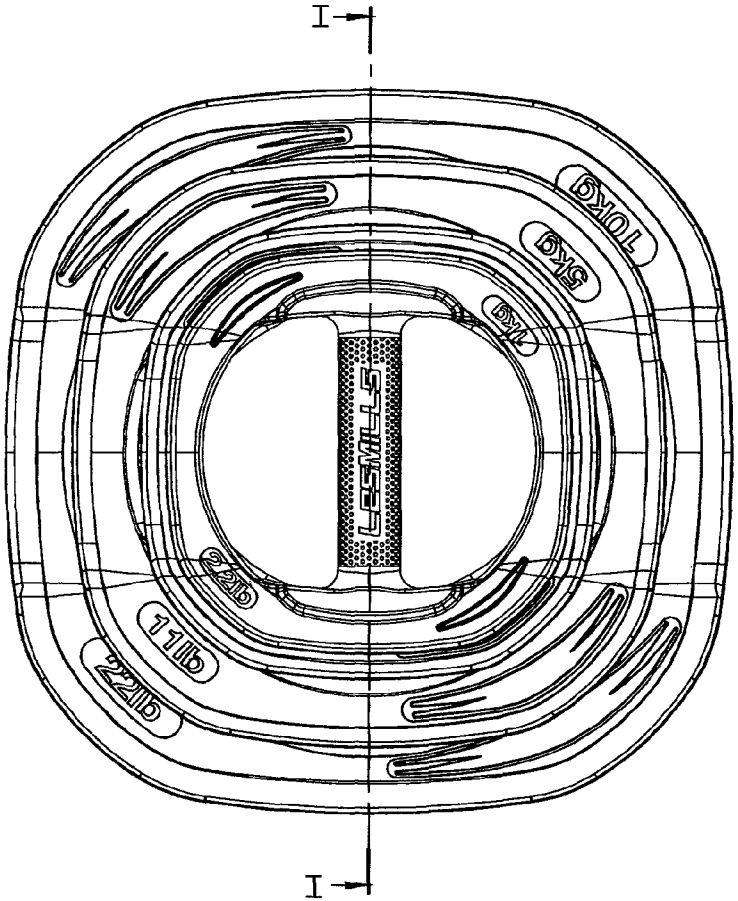
FIG. 39 shows a plan view of the stack of four weight plates of FIG. 37.
Figure 37:
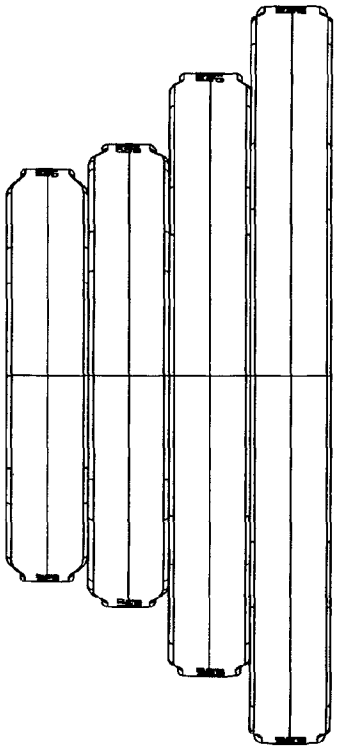
FIG. 37 shows a side view of a stack of four weight plates that may be used with a weight training device of the present invention.
Figure 44:
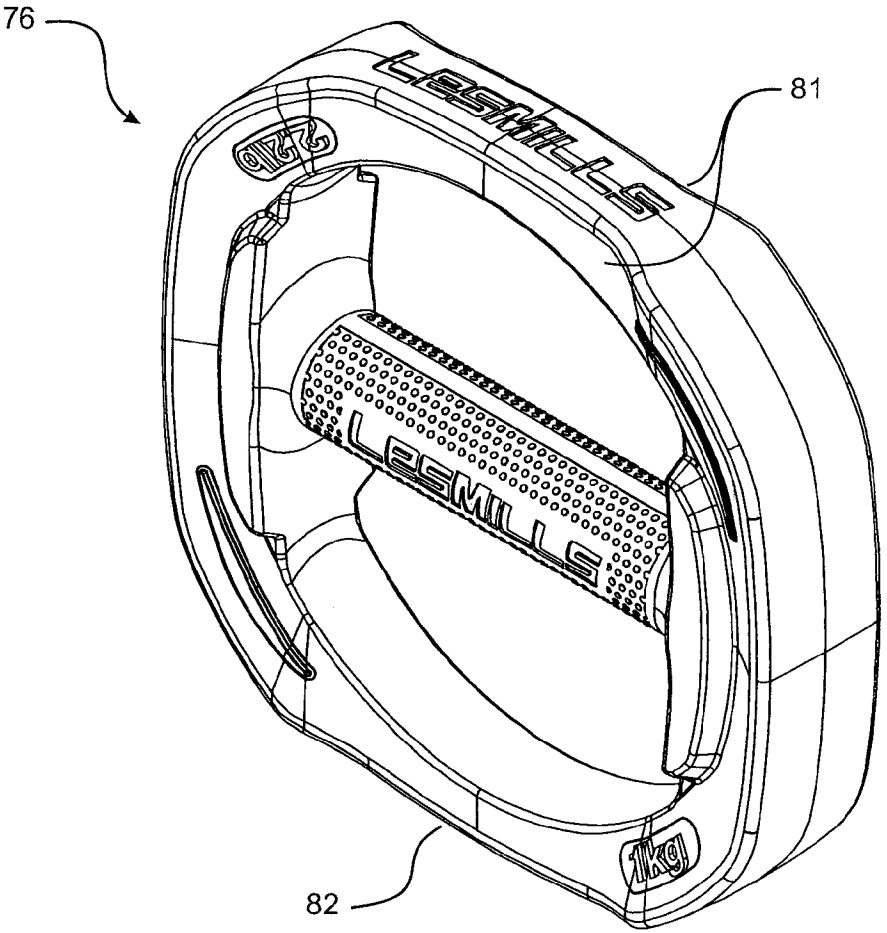
FIG. 44 shows a perspective view of the weight plate of FIG. 41.
Figure 38:
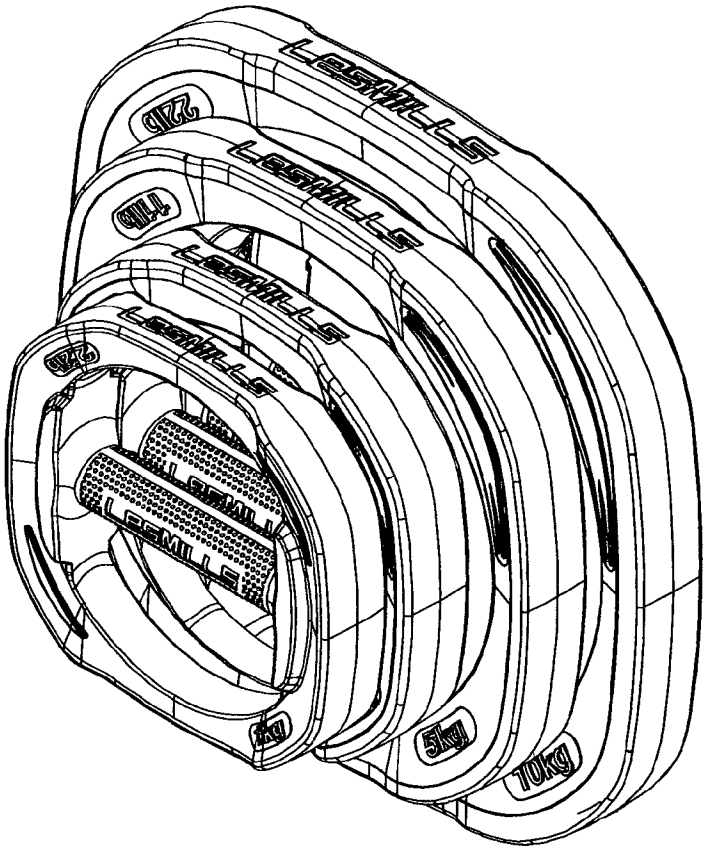
FIG. 38 shows a perspective view of the stack of four weight plates of FIG. 37.
Figure 43:
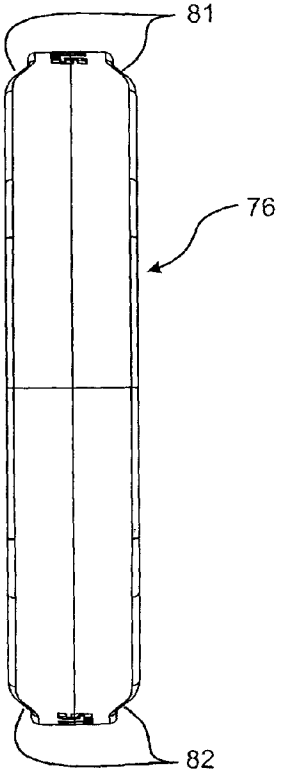
FIG. 43 shows a side view of the weight plate of FIG. 41.
Figure 41:
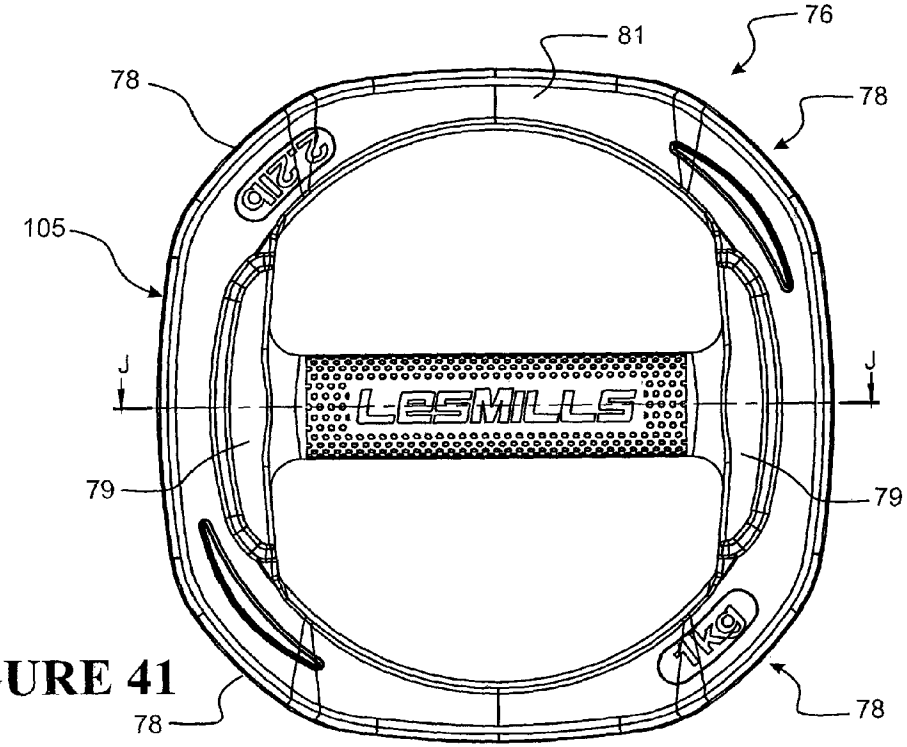
FIG. 41 shows a plan view of a second embodiment of a 1 kg weight plate capable of use with the weight training device of the present invention.
Figure 42:
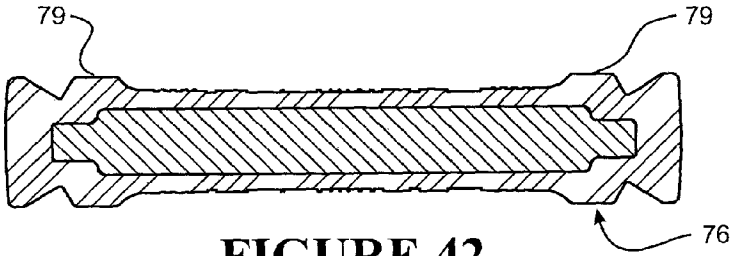
FIG. 42 shows a cross-sectional view of the weight plate through J-J of FIG. 41.
Figure 48:
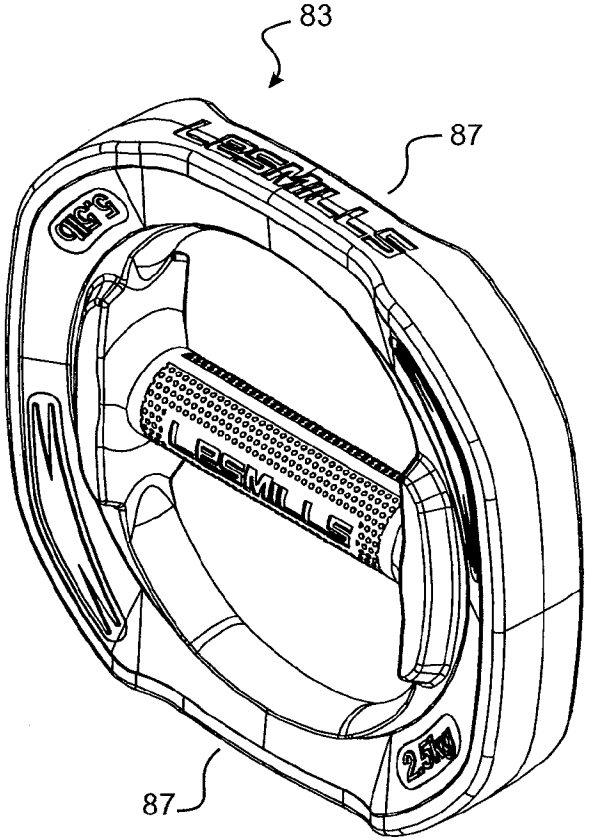
FIG. 48 shows a perspective view of the weight plate of FIG. 45.
Figure 47:
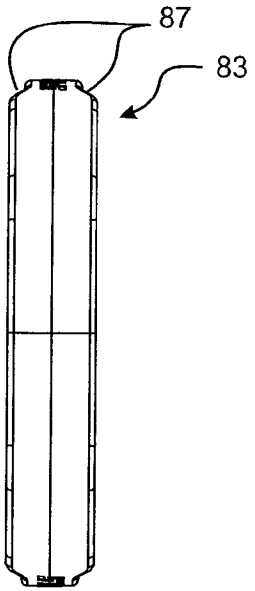
FIG. 47 shows a side view of the weight plate of FIG. 45.
Figure 45:
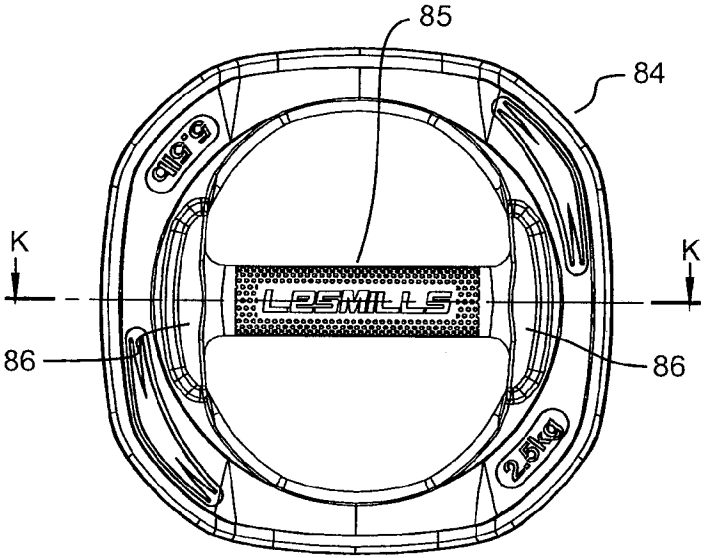
FIG. 45 shows a plan view of a second embodiment of a 2.5 kg weight plate capable of use with the weight training device of the present invention.
Figure 46:
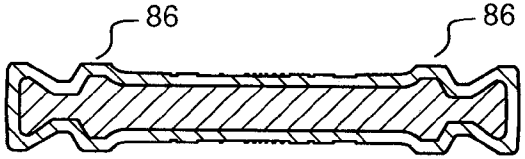
FIG. 46 shows a cross-sectional view of the weight plate through K-K of FIG. 45.
Figure 49:
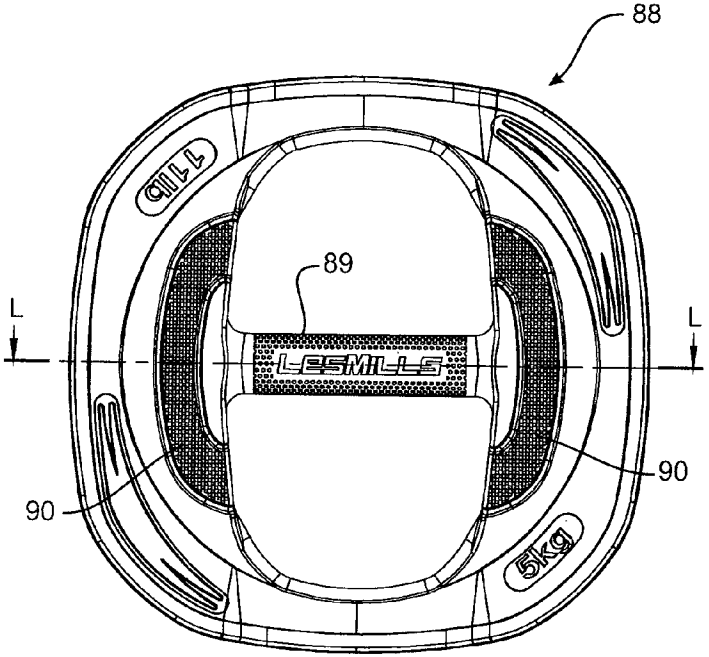
FIG. 49 shows a plan view of a second embodiment of a 5 kg weight plate capable of use with the weight training device of the present invention.
Figure 50:
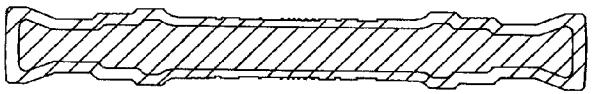
FIG. 50 shows a cross-sectional view of the weight plate through L-L of FIG. 49.
Figure 51:
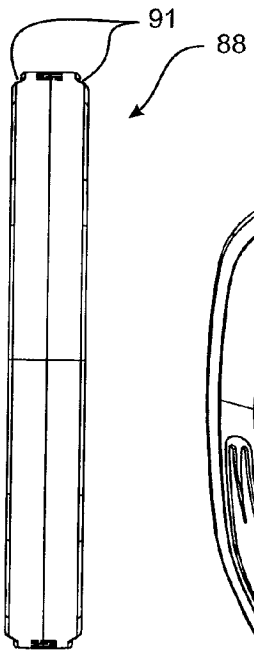
FIG. 51 shows a side view of the weight plate of FIG. 49.
Figure 52:
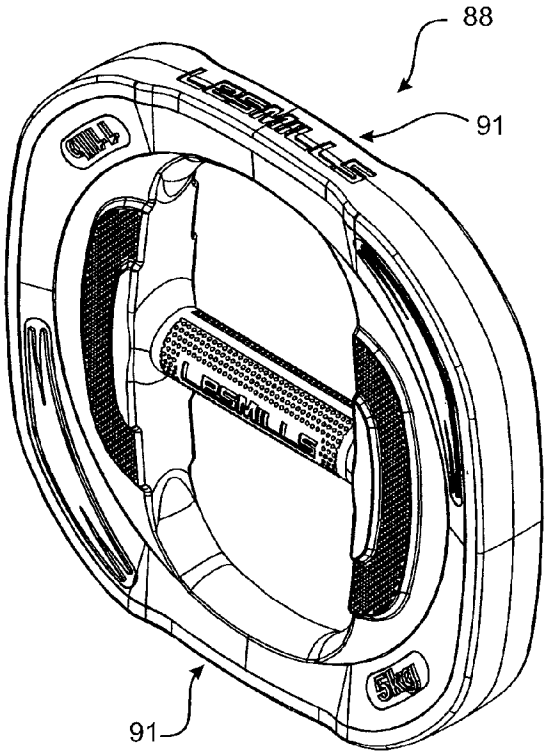
FIG. 52 shows a perspective view of the weight plate of FIG. 49.
Figure 56:
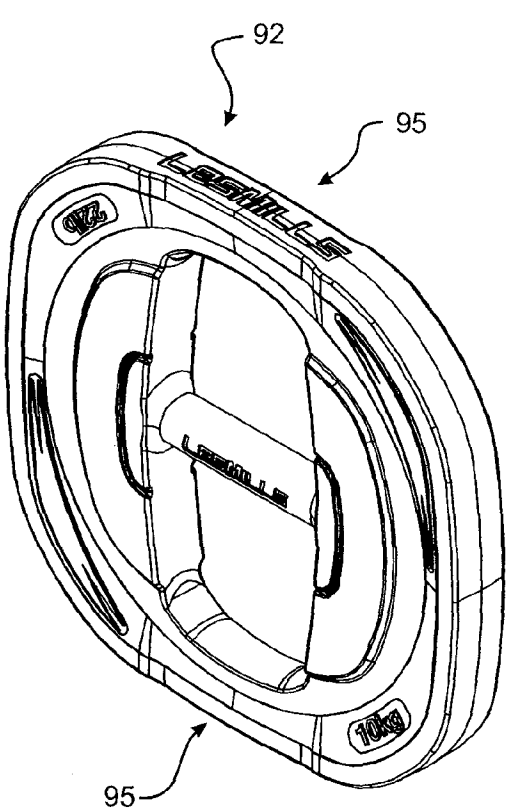
FIG. 56 shows a perspective view of the weight plate of FIG. 53.
Figure 55:
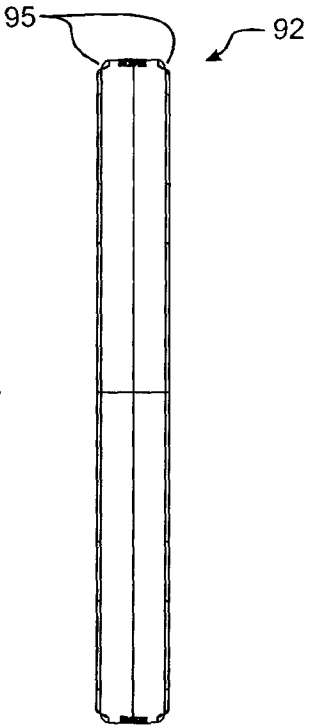
FIG. 55 shows a side view of the weight plate of FIG. 53.
Figure 53:
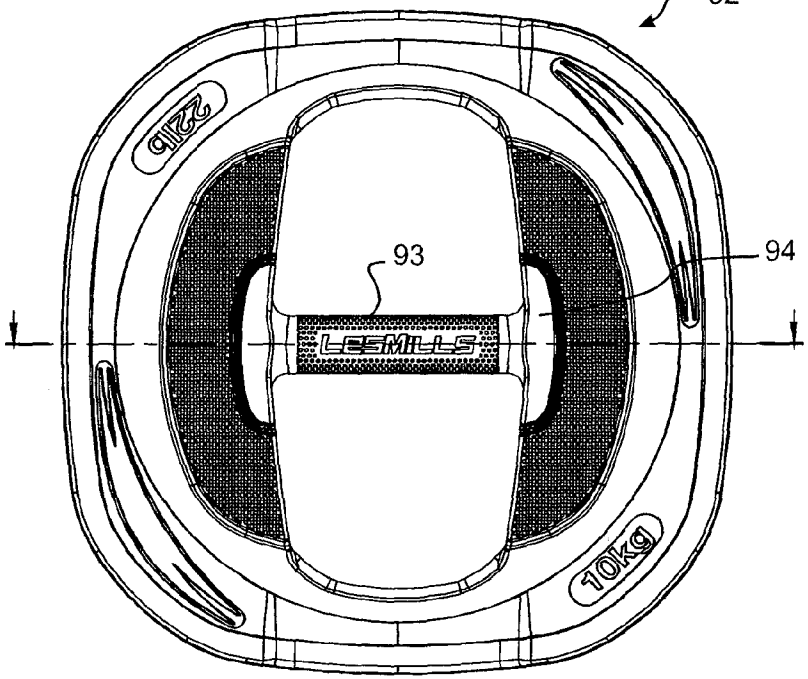
FIG. 53 shows a plan view of a second embodiment of a 5 kg weight plate capable of use with the weight training device of the present invention.
Figure 54:
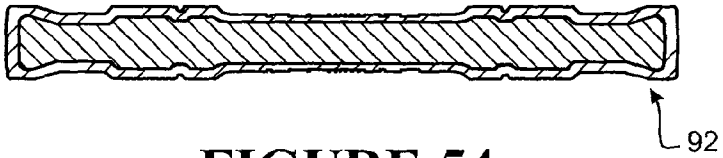
FIG. 54 shows a cross-sectional view of the weight plate through M-M of FIG. 53.

The weight plates are constructed such that they register with each other, either as a stack for storage for example, or in use together in correct alignment in the docking assemblies. FIGS. 37 to 40 show a stack of four weight plates. In FIG. 40, the cross sectional view of the stacked weight plates shows how each weight plate has support faces 66, 67, 68, 69 that abut one another. Furthermore, each of the three smaller weights has edges 70, 71, 72, 73 with flared portions 74 that register in a recessed area 75 in the immediately adjacent larger weight. In this manner the registering and correct stacking of weight plates is enabled.

FIGS. 41 to 44 show a second embodiment of a 1 kg weight plate of the present invention. The weight plate 76 is substantially square in shape with curved edges 78. The weight plate has a core, preferably cast from steel. However, other appropriate materials may be used. An outer plastics covering is overmoulded about the weight plate. The outer covering may be comprised of a silicone rubber, similar elastomer or other appropriate material. The weight plate 76 has support faces 79 that are raised areas that in use butt against the support faces of adjacent weight plates to help ensure the pitch between the weight plates is maintained when a plurality of weight plates are located on a docking assembly. The weight plate 76 has a handle 80 bisecting the weight plate. The handle 80 has a plastics over mould that provides a grippable region for a user and also a mounting region to which the weight plate may be mounted into a docking assembly as herein described.

The weight plate 76 has outer gripping regions 81, 82. These regions are scalloped areas in the weight that form external diametrically opposed handles that a user may grip with one hand or use both hands to grip each of the opposed handles to pick up the weight. Also, the scalloped areas allow for easier gripping and removal of the weight plate from the docking assembly when removing the weight plate from the assembly.

FIGS. 45 to 48 show a second embodiment of a 2.5 kg weight plate of the present invention. This weight plate 83 is similar in shape to the 1 kg weight plate described above, that is, substantially square with curved edges 84. This weight plate 83 similarly has a core and plastics over mould, with a handle 85. The weight plate 83 also has support faces 86 and outer gripping regions 87 that work in the same manner as described above in reference to the 1 kg weight plate 76.

FIGS. 49 to 52 show a second embodiment of a 5 kg weight plate of the present invention. This weight plate 88 is shaped as described above with reference to FIGS. 41 to 44, has a handle 89, support faces 90 and outer gripping regions 91.

FIGS. 53 to 56 show a second embodiment of a 10 kg weight plate of the present invention. This weight plate 92 is shaped as described above with reference to FIGS. 41 to 44, has a handle 93, support faces 94 and outer gripping regions 95.

For each of the weight plates immediately described above, as the weight of the plate increases the shallower the scalloped region becomes. In any event, these scalloped regions allow a user as alternative grip to the "inner" handle (mounting region), and enable a two handed grip, where each of the opposed outer handles is gripped by one each of the user's hands. Thus the user can use each of the weight plates as a dumbbell type weight, or with a two handed grip, or for use with the bar and docking assemblies for use in barbell type exercises.

Furthermore, a user can pick up more than one plate rested with another and hold at the same time. As an example, the 1 kg and 2.5 kg are of such size to allow a user to easily pick up both weights by wrapping the fingers of one hand around both handle. The weights can simultaneously be used in dumbbell type exercises.

In further preferred embodiments the weight plates have weight distributions such that it biases the weight of the plate about the bar, in use, to one position. It has been found that when weight plates are non circular (such as is the case with the preferred weight plates shown in FIGS. 24 to 35 and 41 to 56 of the present invention) and used on a bar, when a user places the bar and weights on the ground, as the docking assemblies and weights are capable of rotation, the weights can end up at a resting position that skews the bar. For example, one weight plate could rotate one way and the other the opposite way meaning the bar is skewed out of a horizontal position. When the weights have a weight distribution that causes them to be biased to move into a position, this enables the bar to rest horizontally and skewing is avoided. It is preferred that in use, the weight distribution on each weight plate causes the weight to return to a rotational position where a straight side (for example, see side 105, of which there are four, in FIG. 41) is parallel to the floor. The weight plate might have its weight distributed more so at the perimeter to achieve this. However, other possible embodiments where the weight is distributed at different areas over the weight plate may be used.

In other forms each weight plate may be a multifaceted perimeter shape, preferably polygonal.

Furthermore, a set a weight plates may be provided where each weight plate is of a different plan shape.

Figure 57:
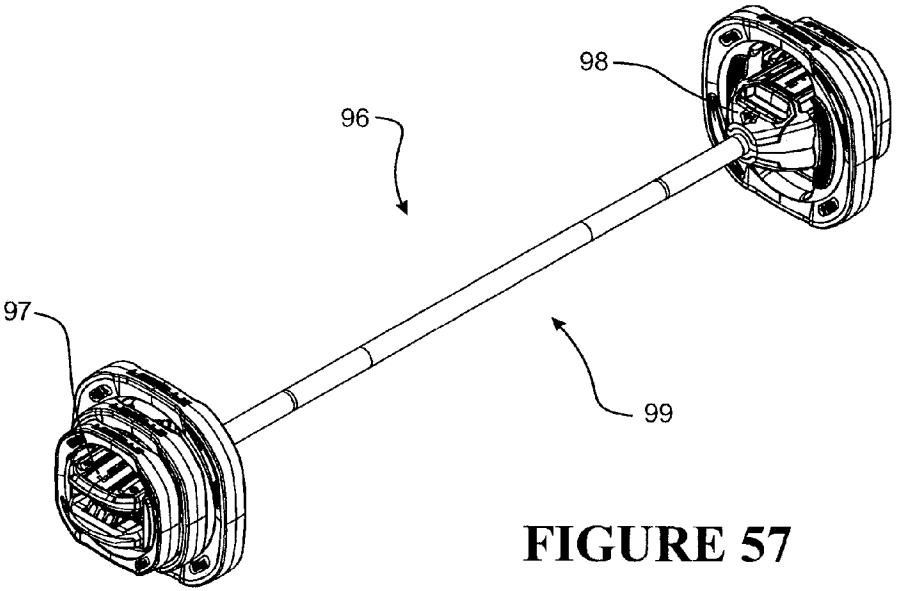
FIG. 57 shows a perspective view of an assembled weight training device.
Figure 58:
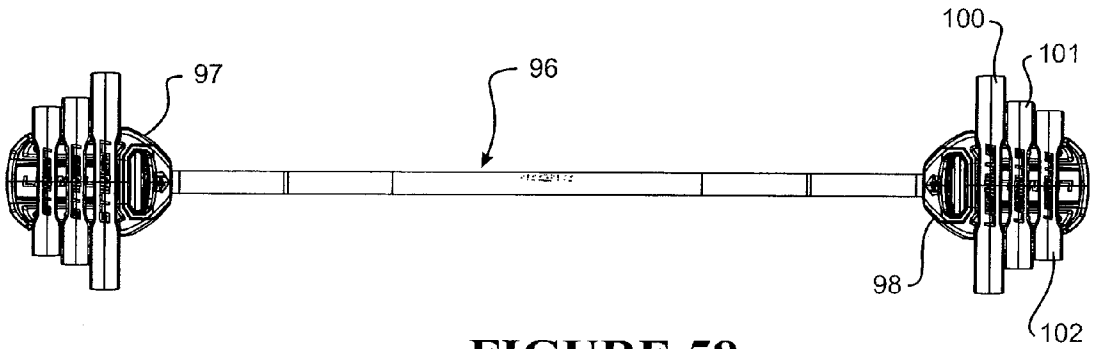
FIG. 58 shows a plan view of the assembled device of FIG. 57.

FIGS. 57 and 58 show an assembled weight training device 96 with docking assemblies 97, 98 at each end of a bar 99, where three weights, for example, 10 kg 100, 5 kg 101 and 2.5 kg 102 are loaded on the docking assemblies 97, 98 in a vertically stacked manner.

Figure 59:
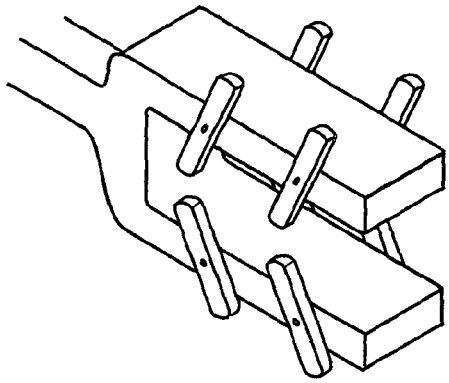
FIG. 59 shows an alternative embodiment of a docking assembly that may be used with the weight training system of the present invention.

FIG. 59 shows an alternative embodiment of a docking assembly that may be used with the weight training system of the present invention. Only one docking assembly 110 is shown. The docking assembly has upper and lower arms 111, 112, forming a slot 114 capable of receiving at least one weight plate. On the arms 111, 112 are locking members 113 that are pivotable about pivots 115. These locking members work in a similar manner as is described above, in that when a mounting region (inner handle) of a weight plate is slid into the slot 114, the handle pushes against the locking members 113, so that the locking members 113 pivot, against their bias, about the pivots 115.

Figure 60:
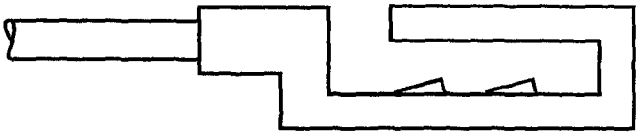
FIG. 60 shows yet another alternative embodiment of a docking assembly with locking members.
Figure 61:
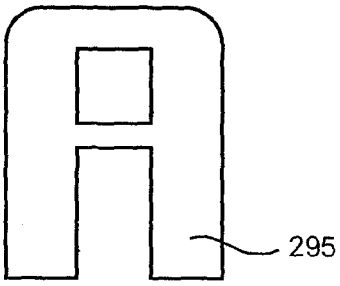
FIG. 61 shows an illustration of a weight plate for use with the docking assembly of FIG. 60.

FIG. 60 shows yet another embodiment of an alternative docking assembly 120. Here the docking assembly 121 has upper and lower arms 122, 123 and a slot 124 is formed between. However, the entrance 125 to the slot is not horizontal as with the other embodiments described, but vertical. The docking assembly 121 may have locking members 126 similar to the ones described above with reference to FIGS. 2 to 6. In use, a weight plate 130 as shown in FIG. 61, in the shape of a capital A, for example, would have to be used with the docking assembly 120.

Figure 62:
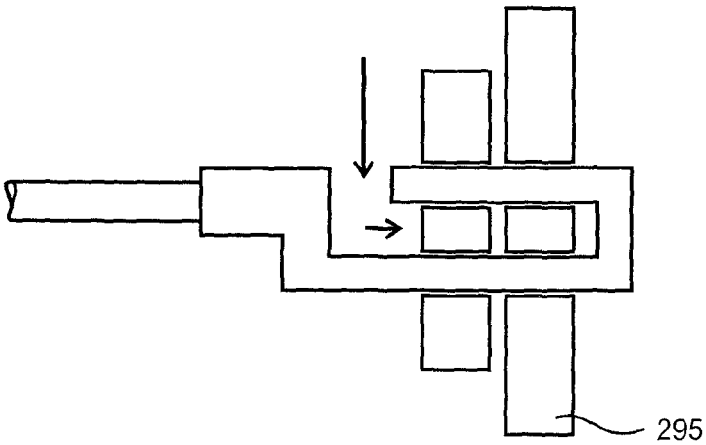
FIG. 62 shows the docking assembly of FIG. 60 in use with two weight plates having been slid onto the docking assembly.

FIG. 62 shows the docking assembly of FIG. 60 in use with two weight plates having been slid onto the docking assembly. As can be seen the handle 131 of the weight plates is slid into that slot 124 in the direction of arrow Z.

Any of the weight plates are herein described may be manufactured in different colours and have branding located thereon, as desired.

The present invention may be used for fitness classes such as the BODY PUMP® class developed and licensed by Les Mills International Limited. The ability to quickly attach and detach weight plates to the bar means that the present invention lends itself to fitness classes where the weights are being changed often. The present invention also lends itself to use in any other gym or exercise regime due to the ease with which weights can be attached and detached.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. Exercise equipment comprising:

a grippable handle at which said exercise equipment can be lifted by a user, a docking assembly connected to the grippable handle, the docking assembly defining a slot at which at least one weight plate can be removably mounted and having at least one locking member to lock the at least one weight plate to the docking assembly once received at the slot, said slot being defined by opposed arms at opposed sides of the slot, wherein said at least one locking member is able to move relative to said opposed arms between a first locking position, toward which the at least one locking member is based, and a second unlocked position, and wherein as the weight plate is received by the slot the weight plate pushes against the bias of said locking member to move the locking member to the unlocked position momentarily until the weight plate is slid deeper into the slot and past the locking member, where the locking member returns under bias to the locking position.

2. Exercise equipment according to claim 1 further comprising an elongate bar that defines the grippable handle.

3. Exercise equipment according to claim 2 wherein said docking assembly is engaged with the bar at each end of the bar.

4. Exercise equipment according to claim 2 wherein said docking assembly is engaged with the bar at each end of the bar in a manner to allow the at least one weight plate to rotate relative to said bar.

5. Exercise equipment according to claim 2 wherein said docking assembly is engaged with the bar at each end of the bar in manner to allow the docking assembly to rotate relative to the bar.

6. Exercise equipment according to claim 5 wherein the docking assembly defines bearing surfaces at the slot that are at least in part complementary in shape to at least part of the mounting region of the weight plate to allow a snug receipt of the weight plate at the slot of the docking assembly.

7. Exercise equipment according to claim 2 wherein the slot is an elongate slot that extends in a direction parallel to the elongate bar.

8. Exercise equipment according to claim 1 wherein the exercise equipment also comprises at least one weight plate.

9. Exercise equipment according to claim 8 wherein said at least one weight plate includes a mounting region by which said weight plate is capable of being mounted to the docking assembly.

10. Exercise equipment according to claim 9 wherein the mounting region of said at least one weight plate is received in the slot of the docking assembly.

11. Exercise equipment according to claim 9 or 10 wherein the slot is dimensioned to receive said weight plate at its mounting region in a sliding manner.

12. Exercise equipment according to claim 9 wherein the mounting region of the weight plate is defined by a handle that extends in a direction that substantially bisects the weight plate.

13. Exercise equipment according to claim 1 wherein the at least one locking member extends partially into the slot from at least one of the opposed arms.

14. Exercise equipment according to claim 13 wherein both opposed arms of the docking assembly carry a plurality of locking members.

15. Exercise equipment according to claim 13 wherein both arms of the docking assembly each carry three locking members to define three opposed pairs of locking members, each pair cooperating, in use, to lock a mounting region of a weight plate to the docking assembly.

16. Exercise equipment according to claim 1 wherein the at least one locking member extends partially into the slot from both of the opposed arms.

17. Exercise equipment according to claim 1 wherein at least one locking member extends into the slot more so when in the first locking position than in the second unlocked position.

18. Exercise equipment according to claim 1 wherein at least one locking member can move between the first locking position wherein said at least one locking member extends at least partially into the slot and the second unlocked position wherein the at least one locking member is at least partially retracted into a respective arm of said opposed arms.

19. Exercise equipment according to claim 1 wherein said at least one locking member is pivotally mounted to rotate about a pivot axis relative to said slot such that each locking member can pivot between the first locking position and the second unlocked position.

20. Exercise equipment according to claim 1 wherein said at least one locking member is pivotally mounted to rotate about a pivot axis relative to said slot such that each locking member can pivot between a first weight plate locking position holding said weight plate to said docking member and the second weight plate unlocked position allowing said weight plate to be removed from the docking member.

21. Exercise equipment according to claim 1 wherein a torsion spring is associated with each locking member and biases each locking member to the first locking position.

22. Exercise equipment according to claim 1 wherein a plurality of weight plates can be sequentially received at the slot of the docking assembly, each weight plate being locked in place by a pair of locking members.

23. Exercise equipment according to claim 1 wherein the at least one locking member is moveable or freed to be able to move by manipulation of an actuator.

24. Exercise equipment according to claim 23 wherein the actuator has a translating cam profile corresponding with the or each locking member, the translating cam profile bearing against a follower of the locking member such that linear movement of the actuator causes the locking member to pivot about a pivot axis as the follower is moved by the translating cam profile.

25. Exercise equipment according to claim 23 wherein the actuator is moved by a release catch, the catch able to be pulled away from the docking assembly to thereby retract or allow retraction of the locking members.

26. Exercise equipment according to claim 25 wherein the release catch is biased for movement toward the docking assembly.

27. Exercise equipment according to claim 1 wherein the docking assembly can receive a plurality of weight plates.

28. Exercise equipment according to claim 27 wherein the plurality of weight plates each have identical mounting regions.

29. Exercise equipment according to claim 27 wherein the plurality of weight plates are able to be held by the docking assembly in a contiguous manner.

30. Exercise equipment according to claim 27 wherein when held by the docking assembly the plane of the plurality of weight plates is substantially perpendicular to the longitudinal axis of the grippable handle.

31. Exercise equipment according to claim 27 wherein the plurality of weight plates can be kept in alignment when held by the docking assembly as they are positioned against one another.

32. Exercise equipment according to claim 1 wherein each weight plate has at least one support face on each of its sides, each support face positioned to butt against the support face of like, adjacent weight plates to maintain the pitch of the weight plates when a plurality of weight plates are positioned adjacent one another at the docking assembly.

33. Exercise equipment according to claim 1 wherein each weight plate has at least one outer gripping region.

34. Exercise equipment according to claim 33 wherein said at least one outer gripping region comprises two diametrically opposed openings in each weight plate that define handles with and at the perimeter of the weight plate for gripping by a user in use.

* * * * *